US009032557B2

(12) United States Patent
Bryant et al.

(10) Patent No.: US 9,032,557 B2
(45) Date of Patent: May 19, 2015

(54) PROTECTIVE HELMET

(71) Applicants: Mark Bryant, Allambie Heights (AU); John Vozzo, Narraweena (AU)

(72) Inventors: Mark Bryant, Allambie Heights (AU); John Vozzo, Narraweena (AU)

(73) Assignee: Voztec Limited, Pyrmont (AU)

( * ) Notice: Subject to any disclaimer, the term of this patent is extended or adjusted under 35 U.S.C. 154(b) by 6 days.

(21) Appl. No.: 13/957,634

(22) Filed: Aug. 2, 2013

(65) Prior Publication Data

US 2014/0026298 A1 Jan. 30, 2014

Related U.S. Application Data

(63) Continuation of application No. 13/824,181, filed as application No. PCT/AU2011/001397 on Nov. 1, 2011, now Pat. No. 8,572,767.

(30) Foreign Application Priority Data

| | | |
|---|---|---|
| Nov. 1, 2010 | (AU) | 2010904867 |
| Mar. 18, 2011 | (AU) | 2011900962 |
| Mar. 21, 2011 | (AU) | 2011901037 |

(51) Int. Cl.

| | |
|---|---|
| ***A42B 3/32*** | (2006.01) |
| ***A42B 3/04*** | (2006.01) |
| ***A42B 3/08*** | (2006.01) |
| *A42B 3/00* | (2006.01) |

(52) U.S. Cl.

CPC .. *A42B 3/08* (2013.01); *A42B 3/328* (2013.01)

(58) Field of Classification Search

CPC ..... A42B 3/328; A42B 3/04; A42B 3/08; A42B 3/324; A44B 11/25; A63B 71/10

USPC ..... 2/425, 421, 422, 410, 6.1, 417; 24/458, 24/648

See application file for complete search history.

(56) References Cited

U.S. PATENT DOCUMENTS

| | | | | |
|---|---|---|---|---|
| 3,686,690 | A * | 8/1972 | Webb | 2/9 |
| 3,713,192 | A * | 1/1973 | Wallin | 24/645 |
| 3,789,467 | A * | 2/1974 | Aratani et al. | 24/648 |
| 3,943,571 | A * | 3/1976 | Boatman | 2/421 |
| 4,110,847 | A * | 9/1978 | Dera | 2/421 |
| 4,461,044 | A * | 7/1984 | Reiterman et al. | 2/421 |
| 4,641,382 | A * | 2/1987 | Gessalin | 2/421 |
| 4,648,138 | A * | 3/1987 | Brigden et al. | 2/421 |
| 4,885,807 | A * | 12/1989 | Snow, Jr. | 2/424 |
| 4,903,346 | A * | 2/1990 | Reddemann et al. | 2/411 |

(Continued)

FOREIGN PATENT DOCUMENTS

| | | |
|---|---|---|
| GB | 982720 | 2/1965 |
| WO | 2004/019717 A2 | 3/2004 |
| WO | 2007/059575 A1 | 5/2007 |

OTHER PUBLICATIONS

International Search Report and Written Opinion dated Jan. 27, 2012 issued in PCT Application No. PCT/AU2011/001397, filed Nov. 1, 2011.

*Primary Examiner* — Bobby Muromoto, Jr.

(74) *Attorney, Agent, or Firm* — Workman Nydegger

(57) ABSTRACT

Various embodiments of protective helmets are disclosed, with a particular focus on rear opening full-face helmets. Embodiments include an emergency release mechanism tor such helmets, which allows the helmet to be separated into a front and rear shell thereby to facilitate removal from a wearer's head with minimal stress to the neck.

17 Claims, 43 Drawing Sheets

(56) References Cited

U.S. PATENT DOCUMENTS

| | | | | |
|---|---|---|---|---|
| 4,926,854 | A * | 5/1990 | Bode | 128/201.23 |
| 4,985,938 | A * | 1/1991 | Snow, Jr. | 2/424 |
| 5,176,342 | A * | 1/1993 | Schmidt et al. | 244/122 AE |
| 5,542,627 | A * | 8/1996 | Crenshaw et al. | 244/121 |
| 5,787,513 | A * | 8/1998 | Sharmat et al. | 2/411 |
| 6,014,769 | A * | 1/2000 | Baudou et al. | 2/6.1 |
| 6,182,298 | B1 * | 2/2001 | Dampney | 2/422 |
| 6,199,219 | B1 * | 3/2001 | Silken et al. | 2/424 |
| 6,381,758 | B1 * | 5/2002 | Roberts et al. | 2/421 |
| 6,418,564 | B1 * | 7/2002 | Sheridan | 2/425 |
| 7,024,704 | B2 * | 4/2006 | Gafforio et al. | 2/424 |
| 7,096,513 | B1 * | 8/2006 | Kress | 2/410 |
| 8,166,578 | B2 * | 5/2012 | Tan | 2/427 |
| 8,176,574 | B2 * | 5/2012 | Bryant et al. | 2/424 |
| 2002/0083562 | A1 * | 7/2002 | Lerra | 24/115 G |
| 2002/0174480 | A1 * | 11/2002 | Lombard | 2/424 |
| 2003/0070200 | A1 * | 4/2003 | Crye et al. | 2/6.6 |
| 2003/0106138 | A1 * | 6/2003 | Guay | 2/418 |
| 2004/0172739 | A1 * | 9/2004 | Racine | 2/417 |
| 2007/0124852 | A1 * | 6/2007 | Pyo | 2/424 |
| 2008/0092278 | A1 * | 4/2008 | Rogers et al. | 2/422 |
| 2008/0115260 | A1 * | 5/2008 | Schulz et al. | 2/421 |
| 2008/0289085 | A1 * | 11/2008 | Bryant et al. | 2/421 |
| 2010/0064405 | A1 * | 3/2010 | McGovern | 2/6.7 |
| 2010/0229292 | A1 * | 9/2010 | Tan | 2/452 |
| 2011/0131710 | A1 * | 6/2011 | Maddux et al. | 2/424 |
| 2012/0000011 | A1 * | 1/2012 | Grewall | 2/421 |
| 2012/0090079 | A1 * | 4/2012 | Lebel et al. | 2/422 |
| 2013/0104298 | A1 * | 5/2013 | Domenico | 2/425 |

* cited by examiner

SECTION A-A

SECTION A-A

PROTECTIVE HELMET

CROSS-REFERENCE TO RELATED APPLICATIONS

This application is a continuation of U.S. patent application Ser. No. 13/824,181, filed Mar. 15, 2013, entitled "A Protective Helmet," which is a 371 application of PCT/AU2011/001397, filed on Nov. 1, 2011, which claims priority to Australian Patent Application Serial No. 2010904867, filed on Nov. 1, 2010, Australian Patent Application Serial No. 2011900962, filed on Mar. 18, 2011, and Australian Patent Application Serial No. 2011901037, filed on Mar. 21, 2011, the disclosures of which are incorporated herein by this reference in their entirety.

FIELD OF THE INVENTION

The present invention relates to protective helmets. Embodiments of the invention have been primarily developed to provide a protective helmet that is reliably secured to a wearer's head, but conveniently removable in an emergency situation.

BACKGROUND

Any discussion of the prior art throughout the specification should in no way be considered as an admission that such prior art is widely known or forms part of common general knowledge in the field.

Known protective helmets typically consist of a protective shell that is secured to a user's head by way of a chinstrap. Known chinstrap systems used in conventional helmets are by no means ideal. For example: the helmet is susceptible, during an impact, to being moved out of the intended alignment with the head. This misalignment is known to increase the risk of injury of the user—for example if the temple region is exposed. In addition, chinstraps are known to break. This results in further adverse positioning—or indeed inadvertent compete removal of the helmet.

One approach for avoiding complications associated with chinstraps is to use a rear-opening helmet design, such as that disclosed in PCT/AU2006/001770. Such a helmet includes a front shell a rear shell moveable with respect to the front shell to provide an open configuration for receiving within the helmet or removing from the helmet a head; and a closed configuration wherein the rear shell is releasably lockingly engaged to the front shell for securely containing the head within the helmet.

SUMMARY OF THE INVENTION

Embodiments of the present invention have been developed to overcome or ameliorate various disadvantages of the prior art, or to provide a useful alternative.

One embodiment provides a protective helmet including:

a front shell; and a rear shell hingedly movable with respect to the front shell to provide:

an open configuration in which the helmet is able to be placed on a user's head or removed from the user's head; and a closed configuration wherein the rear shell is releasably lockingly engaged to the front shell for securely containing the head within the helmet;

a multiple point locking system including:

an upper dorsal connection for hingedly connecting the rear shell to front shell, thereby to enable movement between the closed configuration and the open configuration.

one or more lower side connections for releasably locking the front shell to the rear shell thereby to selectively lock the helmet in the closed configuration; and an emergency release mechanism configured to simultaneously release the hinge and unlock the lower side connections such that the rear shell is removable from the front shell.

One embodiment provides a protective helmet including:

a front shell having a primary vision aperture formed therein; and a rear shell hingedly movable with respect to the front shell to provide:

an open configuration in which the helmet is able to be placed on a user's head or removed from the user's head; and a closed configuration wherein the rear shell is releasably lockingly engaged to the front shell;

a protective cage assembly including a protective cage that overlies the primary vision aperture; and a protective cage mounting assembly formed of resilient material, the protective cage mounting assembly being mounted intermediate the protective cage assembly and the front shell such that the resilient material allow limited damped movement of the protective cage assembly with respect to the front shell.

One embodiment provides a protective helmet including:

a front shell having a primary vision aperture formed therein; and a rear shell hingedly movable with respect to the front shell to provide:

an open configuration in which the helmet is able to be placed on a user's head or removed from the user's head; and a closed configuration wherein the rear shell is releasably lockingly engaged to the front shell;

wherein the front shell includes a first edge complimentarily engageable with a second edge on the rear shell;

wherein the first and second edges include respective complimentary inter-engaging locating formations extending substantially along the length of the edges, these locating formations being mutually locatingly engaged when the helmet is in the closed configuration to substantially transversely locate the front shell with respect to the rear shell;

wherein the complementary locating formations and shells are configured such that, when progressing the helmet from the open configuration to the closed configuration, there is continuous progressive engagement the locating formations of the front shell and the locating formations of the rear shell.

One embodiment provides a protective helmet including:

a front shell; and a rear shell hingedly movable with respect to the front shell to provide:

an open configuration in which the helmet is able to be placed on a user's head or removed from the user's head; and a closed configuration wherein the rear shell is releasably lockingly engaged to the front shell for securely containing the head within the helmet;

a multiple point locking system including:

an upper dorsal connection for hingedly connecting the rear shell to front shell, thereby to enable movement between the closed configuration and the open configuration.

one or more lower side connections for releasably locking the front shell to the rear shell thereby to selectively lock the helmet in the closed configuration; and an emergency release mechanism adjacent the upper dorsal connection configured to simultaneously release the lower side connections such that, following removal of a hinge pin that provides the hinged connection between the front and rear shells, the rear shell is removable from the front shell.

Reference throughout this specification to "one embodiment", "some embodiments" or "an embodiment" means that a particular feature, structure or characteristic described in connection with the embodiment is included in at least one embodiment of the present invention. Thus, appearances of the phrases "in one embodiment", "in some embodiments" or "in an embodiment" in various places throughout this specification are not necessarily all referring to the same embodiment, but may. Furthermore, the particular features, structures or characteristics may be combined in any suitable manner, as would be apparent to one of ordinary skill in the art from this disclosure, in one or more embodiments.

As used herein, unless otherwise specified the use of the ordinal adjectives "first", "second", "third", etc., to describe a common object, merely indicate that different instances of like objects are being referred to, and are not intended to imply that the objects so described must be in a given sequence, either temporally, spatially, in ranking, or in any other manner.

In the claims below and the description herein, any one of the terms comprising, comprised of or which comprises is an open term that means including at least the elements/features that follow, but not excluding others. Thus, the term comprising, when used in the claims, should not be interpreted as being limitative to the means or elements or steps listed thereafter. For example, the scope of the expression a device comprising A and B should not be limited to devices consisting only of elements A and B. Any one of the terms including or which includes or that includes as used herein is also an open term that also means including at least the elements/features that follow the term, but not excluding others. Thus, including is synonymous with and means comprising.

BRIEF DESCRIPTION OF THE DRAWINGS

Embodiments will now be described, by way of example only, with reference to the accompanying drawings in which.

It will be appreciated that, in the different figures, some corresponding features have been denoted by corresponding reference numerals.

DETAILED DESCRIPTION

Figure 1:
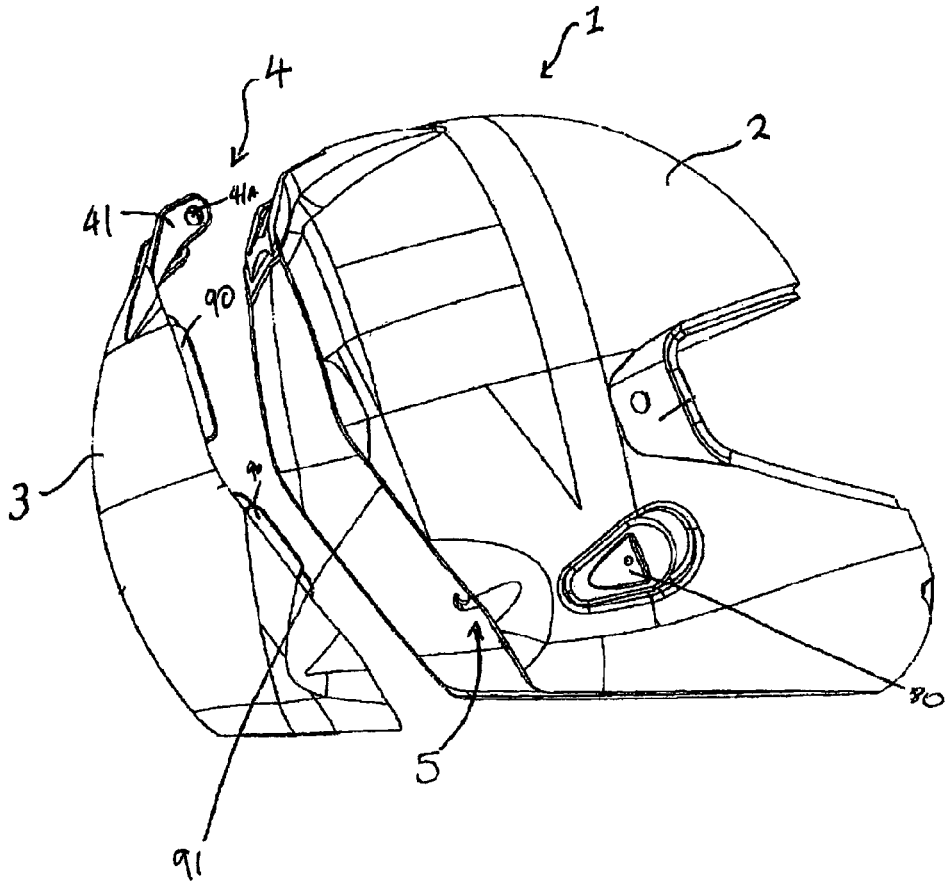
FIG. 1 illustrates a helmet according to one embodiment, shown in side view with rear shell disconnected from front shell.

The present disclosure is concerned with technology for protective helmets, with a particular focus on rear opening full-face helmets. Embodiments are primarily focussed on an emergency release mechanism for such helmets, which allows the helmet to be separated into a front and rear shell thereby to facilitate removal from a wearer's head with minimal stress to the neck.

Rear-opening helmet design is discussed at length in PCT/AU2006/001770, which is herein incorporated in reference in its entirety. Although the teachings of that document will generally be regarded as assumed knowledge for the present purposes, a brief overview of rear opening helmet technology is provided below.

In overview, the term "rear opening helmet" is used to describe a helmet having a front shell and a rear shell hingedly movable with respect to the front shell. The movement of the rear shell with respect to the front shell provides an open configuration in which the helmet is able to be placed on a user's head or removed from the user's head, and a closed configuration wherein the rear shell is releasably lockingly engaged to the front shell for securely containing the head within the helmet. That is, opening the helmet allows it to be placed on a head, and once placed on the head the helmet is closed and locked thereby to secure it to the head. The front and rear shells are configured such that, when in the closed configuration, the helmet is configured for securely containing the head via a closure boundary defined by respective edges of the front and rear shells. This is contrasted with other helmets, which use chin straps or the like as a means for securing the helmet to the head.

Various embodiments described herein are directed to a rear opening helmet that uses a chin cup to allow limited resiliently opposed movement of the jaw upon frontal impact. Specifically, such a helmet includes a forehead fitting zone on the front shell for engagement with the forehead region of the head, and a rear fitting zone provided on the rear shell for engagement with a posterior region of the head. A chin cup fitting zone is provided on an adjustable chin cup for cupping and securing the chin region, and with a spacing intermediate the outer side of the chin cup and the front shell of the helmet thereby to allow limited resiliently opposed movement of the jaw upon frontal impact. These fitting zones collectively provide a three zone fitting system for reliably locating the head within the helmet when worn correctly. Given the rear-opening design, the chin cup is not responsible for maintaining the helmet on the wearer's head; that is achieved by closing the helmet.

As discussed in PCT/AU2006/001770, some embodiments of rear opening helmets make use of interlocking edges. Unless specifically noted otherwise, all embodiments herein optionally make use of interlocking edges as described herein, and/or as described in PCT/AU2006/001770 That is, the front shell includes a first edge complimentarily engageable with a second edge on the rear shell, the first and second edges include respective complimentary inter-engaging locating formations extending substantially along the length of the edges, these locating formations being mutually locatingly engaged when the helmet is in the closed configuration to substantially transversely locate the front shell with respect to the rear shell. These locating formations may be defined by a tone-and-groove arrangement, projection and recess, beaded lip, and so on. Locating formations may be continuous along the edges, or defined at segmented regions.

In addition to what is disclosed in PCT/AU2006/001770 (primarily being locating formations are defined on the helmet shells), embodiments of the present invention optionally include locating formations defined by inserts that the mounted to helmet shells, and in some cases via helmet liners. In some embodiments a combination of those approaches is used (for example the locating formation of one edge being partially defined on an insert and partially defined by the shell, or one along one edge by the shell and the other edge by an insert in whole or in part, and so on).

Furthermore, the present specification provides for some embodiments in the form of rear-opening helmets wherein the complementary locating formations and shells are configured such that, when progressing the helmet from the open configuration to the closed configuration, there is continuous progressive engagement the locating formations of the front shell and the locating formations of the rear shell. For example, the locating formations follow each a respective threaded path (for example a partial turn of a thread), thereby to provided for the continuous progressive engagement. That is, as the helmet is closed, the locating formations begin to engage adjacent the dorsal connection (for example a hinged connection), and progressively engage along the length of the edges to either side of the hinged connection down to the lower periphery of the helmet (which when in the closed configuration defines the neck opening). In some cases this is achieved at least in part by the geometric configuration of the first and second edges (i.e. the "cut-line" between the shells combined with the intrinsic three dimensional shape of the shells) and/or at least in part by the geometric configuration of the locating formations (that is, either or both may be shaped to provide for the continuous engagement). In some embodiments each of the first and second edges follow helical threaded paths—preferably defined in three dimensions by less than one full turn of a helix (that is, using a helix angle as guidance thereby to achieve an appropriate path).

The utilisation of progressive continuous engagement is significant in terms of helmet locking integrity, for example with regard to ensuring that side connectors are properly aligned each time the helmet is closed.

As noted, the embodiments discussed herein are primarily focussed on an emergency release mechanism a rear opening helmets. An embodiment of such an emergency release mechanism will now be described by reference to FIG. 1 to FIG. 15, which illustrate an exemplary helmet 1.

It will be appreciated that numerous design features shown and/or discussed herein are preferred only, and that core concepts underlying the present technology are applicable across a wide range of helmets with various modifications and/or alternative construction approaches. It will also be appreciated that not all helmet components are illustrated in the drawings. In particular, a number of the drawings show helmet shells without linings (such as EPS linings) which would be inserted into helmets prior to practical use. The rationale for their omission is to allow better views of various components formed on or in the helmet shells. Exemplary EPS linings are shown in FIG. 25A to FIG. 26C.

Helmet 1 includes a front shell 2 and a rear shell 3. Rear shell 3 is hingedly movable with respect to front shell 2 to provide an open configuration in which the helmet is able to be placed on a user's head or removed from the user's head, and a closed configuration wherein the rear shell is releasably lockingly engaged to the front shell for securely containing the head within the helmet. In the case of FIG. 1, the shells are shown separated from one another.

Helmet 1 includes a multiple point locking system including an upper dorsal connection 4 for hingedly connecting rear shell 3 to front shell 2, thereby to enable movement between the closed configuration and the open configuration. The multiple point locking system additionally includes a pair of lower side connections 5 (one on each side of the helmet) for releasably locking the front shell to the rear shell thereby to selectively lock the helmet in the closed configuration. An emergency release mechanism is configured to simultaneously release the hinge of dorsal connection 4 and unlock the lower side connections 5 such that the rear shell 3 is removable from the front shell 2. The term "simultaneously" should not be read to infer exact time correlation; merely that the one motion releases both the hinge and lower side connections.

The emergency release mechanism includes a tab member 10 that is configured to be manually engaged. Specifically, tab member 10 is presently shaped to assist a user to insert their finger (or another object) at point 11, and upwardly lever the tab. Tab member 10 is, in normal use, maintained within a tab recess 13 formed in front shell 2. In this manner, the outer surface of tab 10 sits substantially flush with the outer surface of shell 2. The underside of recess 13 is designated reference numeral 14. It will be appreciated that, in a final product, this is concealed by an EPS liner or the like. As discussed further below, manual manipulation of tab 10 simultaneously releases the hinge of connection 4 and unlocks the lower side connections 5 such that the rear shell 3 is removable from the front shell 2. In the present embodiments manually engaging the tab member 10 includes lifting the tab member.

In general terms, the ability to quickly release the shells from one another is of significant value in emergency situations, particularly where there are concerns of spinal injury. For instance, it provides access to the wearer's mouth and face without having to move/stress the neck (as would be necessary to remove a conventional full-face helmet).

In the present embodiments, tab 10 is physically coupled to the hinge of connection 4 and to side connections 5. Specifically, the tab member is physically coupled to the hinge and side connections by a set of cables, the cables being coupled at their respective proximal ends to the tab member.

Figure 2:
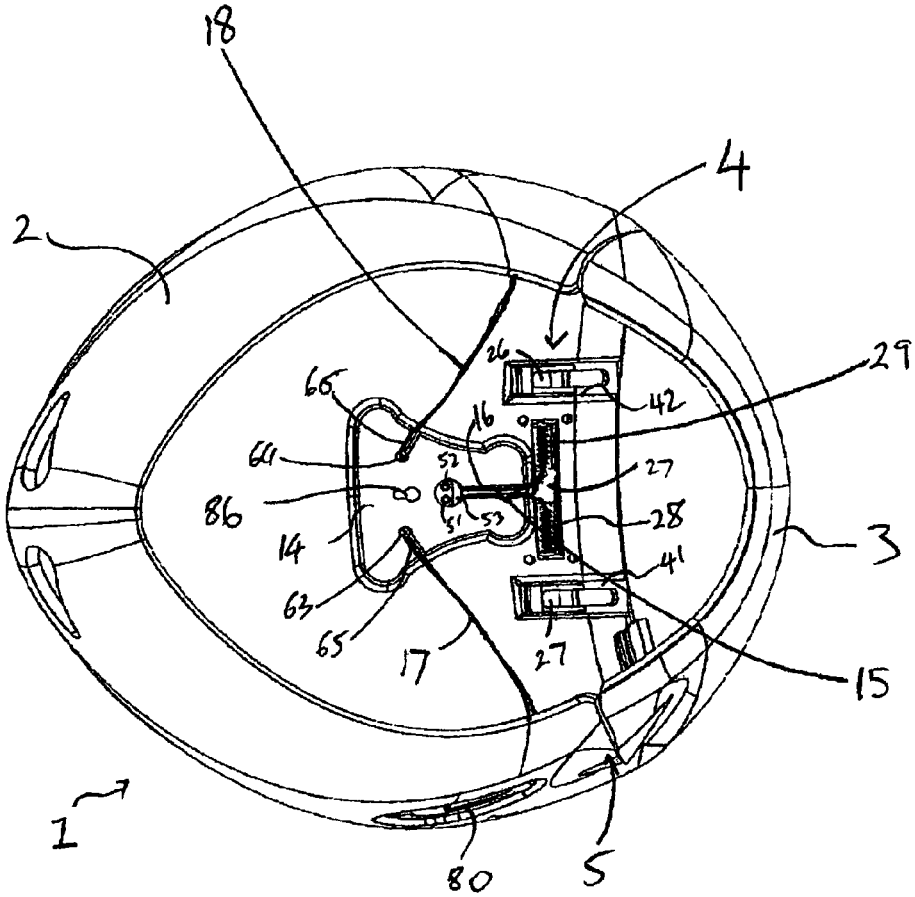
FIG. 2 illustrates a helmet according to one embodiment, shown from below.
Figure 3A:
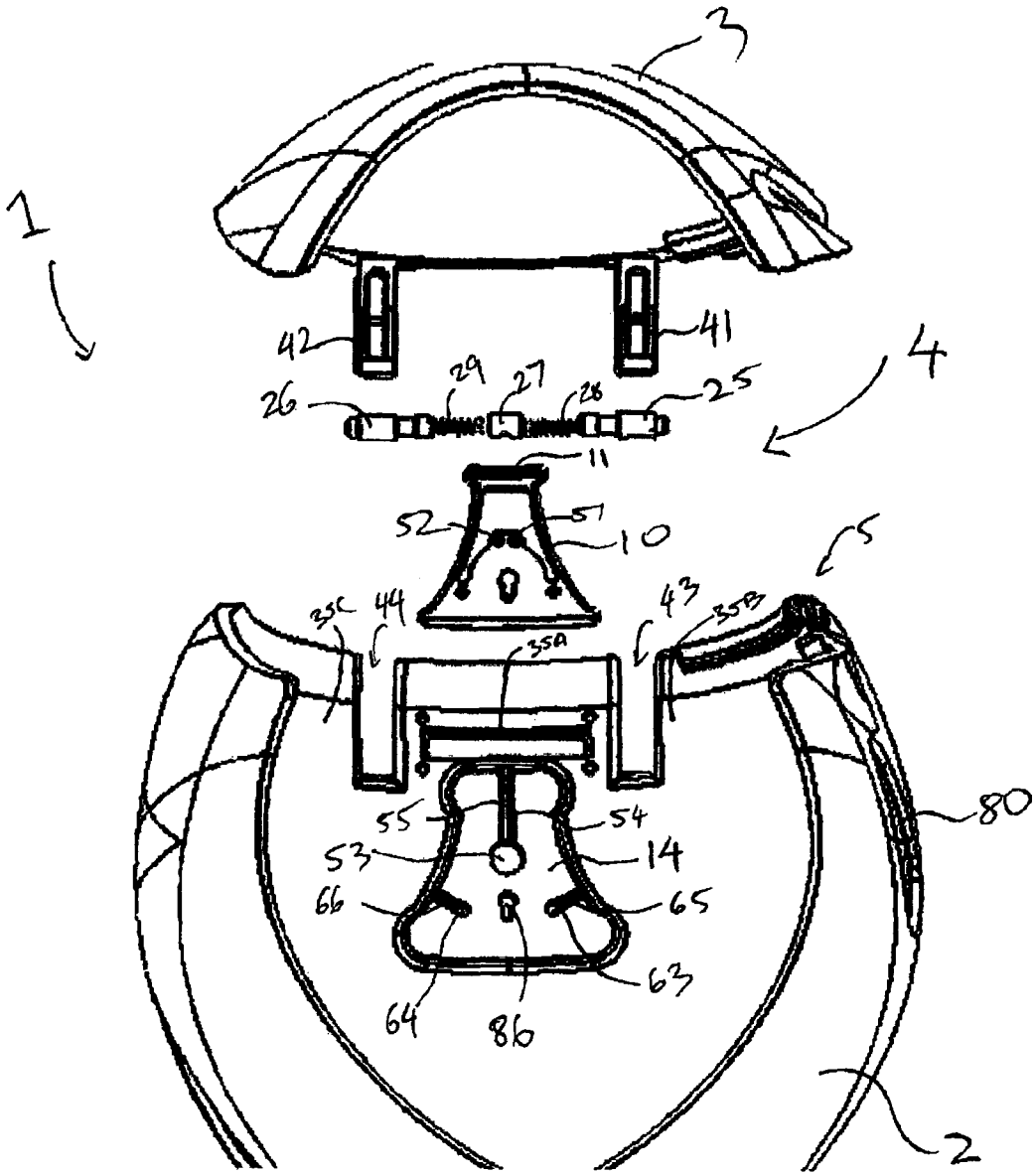
FIG. 3A illustrates a helmet according to one embodiment, shown from below with various components of a hinge assembly separated.
Figure 3B:
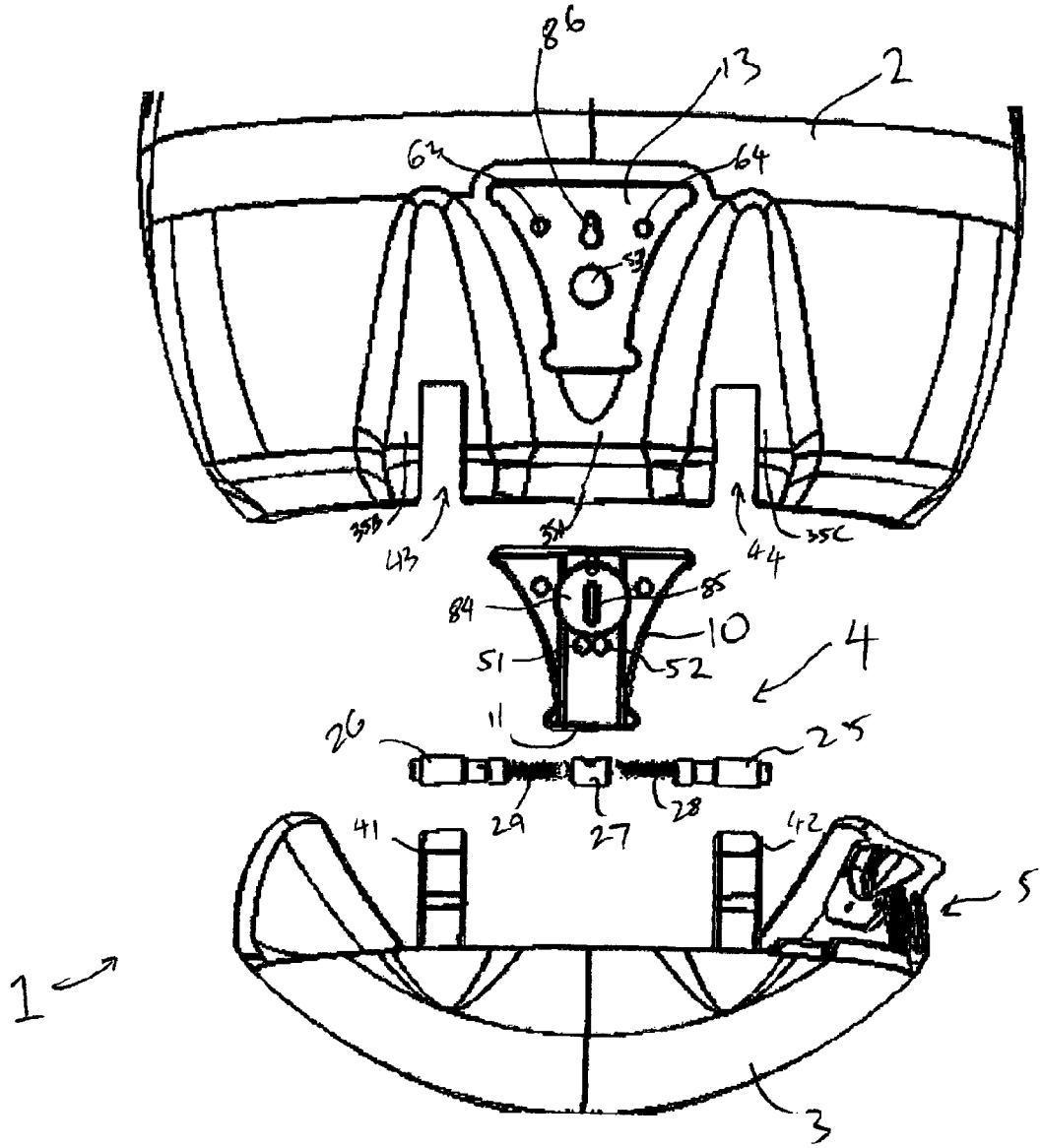
FIG. 3B illustrates a helmet according to one embodiment, shown from above with various components of a hinge assembly separated.
Figure 4:
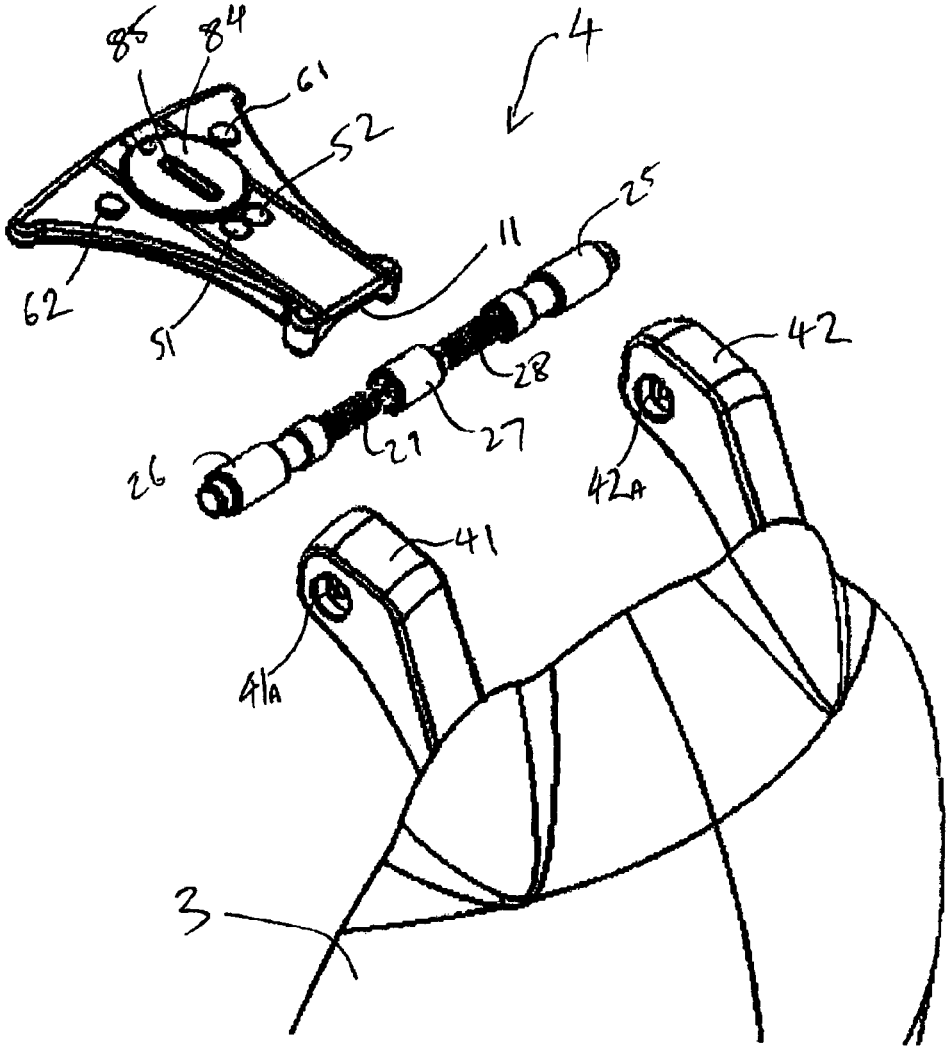
FIG. 4 illustrates hinge and release tab components of a helmet according to one embodiment.

FIG. 2 illustrates cables 15-18 (which may be metallic cables, but do not necessarily have to be formed of metallic material), which are each connected to tab member 10 at their proximal ends. Cables 15 and 16 are coupled to hinges 26 and 27. In some embodiments cables 15 and 16 are defined by a common piece of cable, which is conceptually able to be regarded as two cables interconnected at their respective proximal ends adjacent connection with tab member 10. Cables 17 and 18 are each coupled at their distal ends to a respective movable latch member 40 of one of the lower side connections 5. As discussed further below, manually engaging tab member 10 acts on cables 15-18 thereby to simultaneously move hinges 27 and 27 and latch members 40, which are connected to the distal ends of those cables. This has the effect of releasing the front shell from the rear shell.

FIG. 3A to FIG. 5 provide additional context to the operation of the emergency release mechanism in terms of hinged connection 4. Hinged connection 4 is effected by a pair of hinge pins 25 and 26, which pass through hinge apertures 41A and 42A respectively. Apertures 41A and 41B are formed in hinge 41 and 42, which are part of rear shell 3. The hinge pins also pass through regions 35A, B and C of shell 2 (although the apertures formed within shell 2 are not clearly visible in the drawings).

Figure 5:
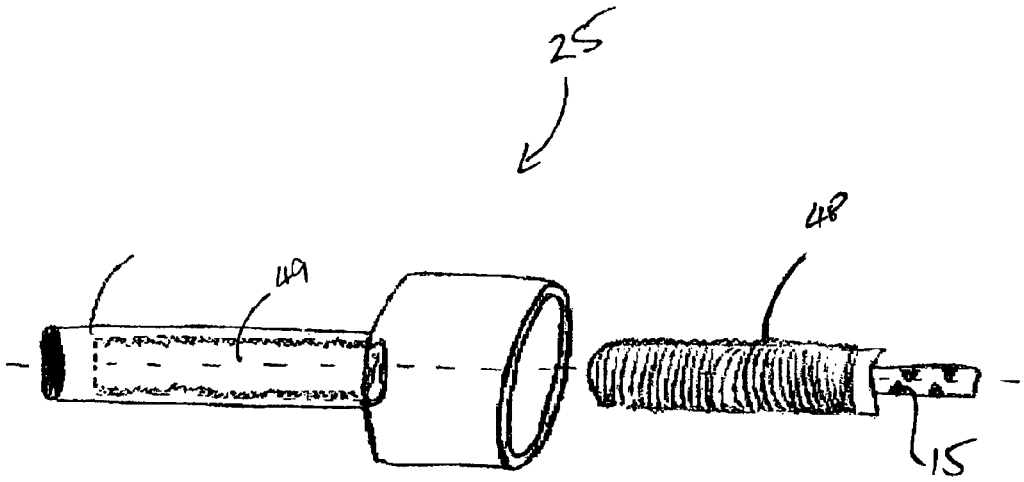
FIG. 5 illustrates hinge components of a helmet according to one embodiment.
Figure 6:
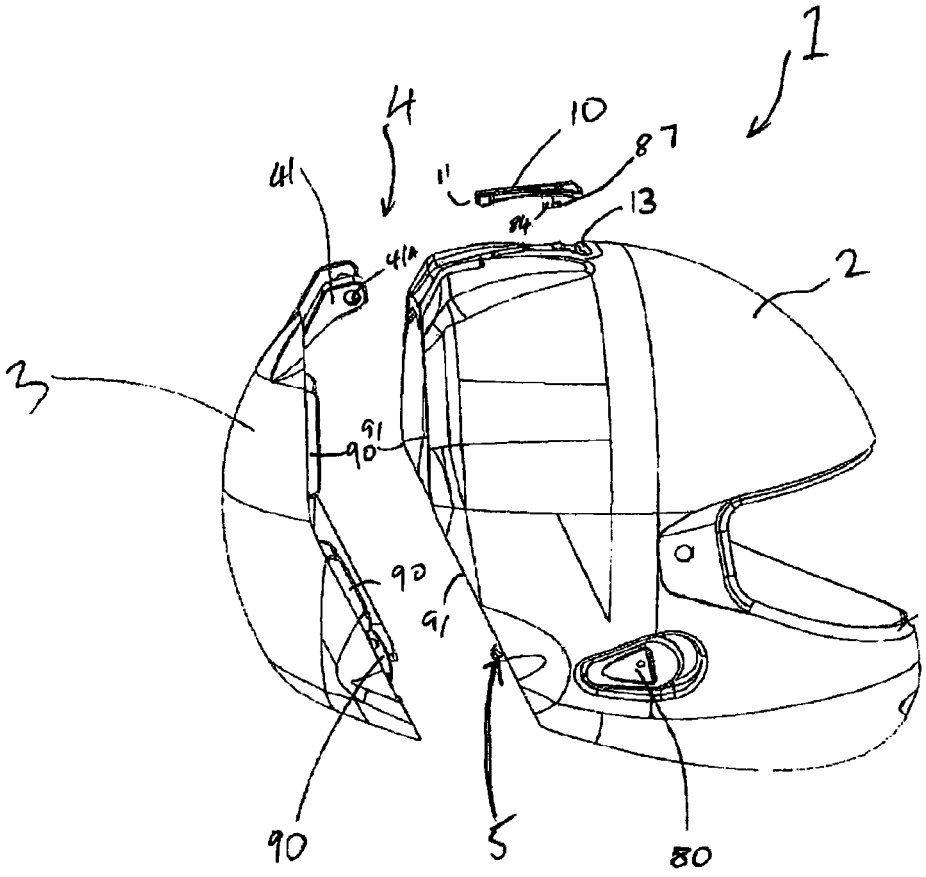
FIG. 6 illustrates a helmet according to one embodiment, shown in side view with rear shell disconnected from front shell and a release tab removed.
Figure 7:
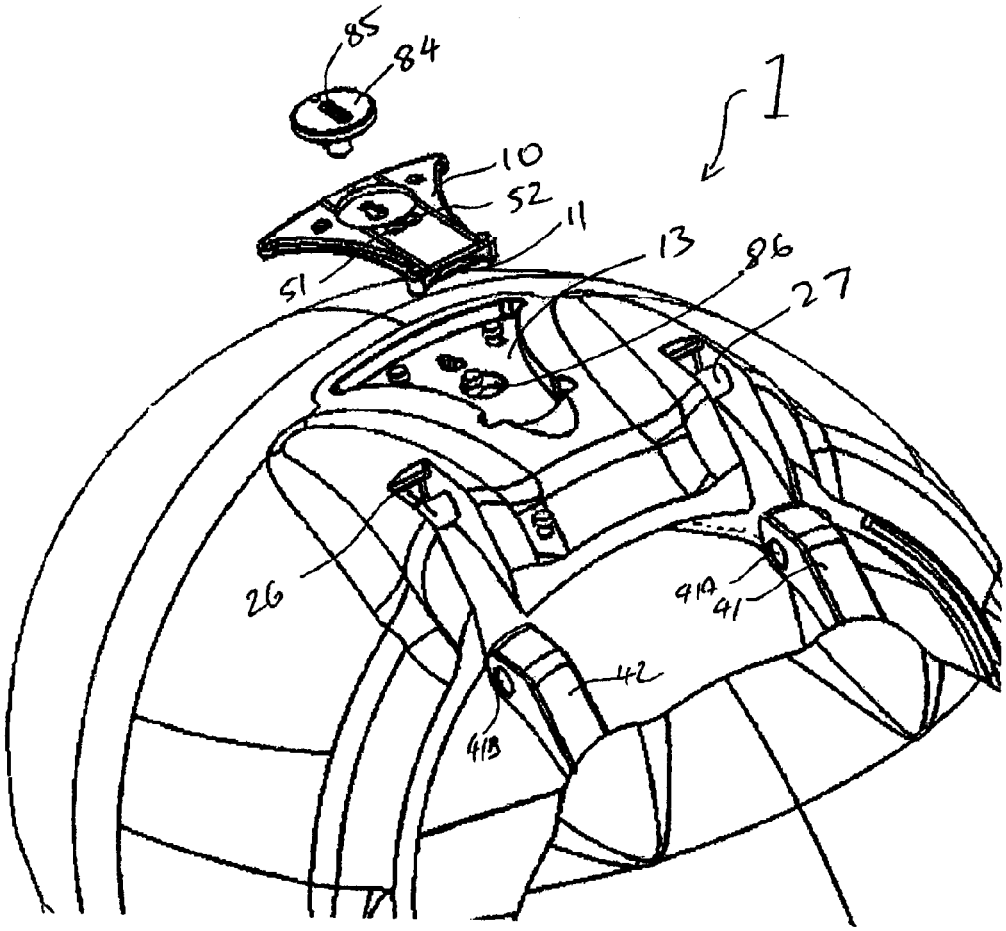
FIG. 7 illustrates components of a release tab for a helmet according to one embodiment.
Figure 8:
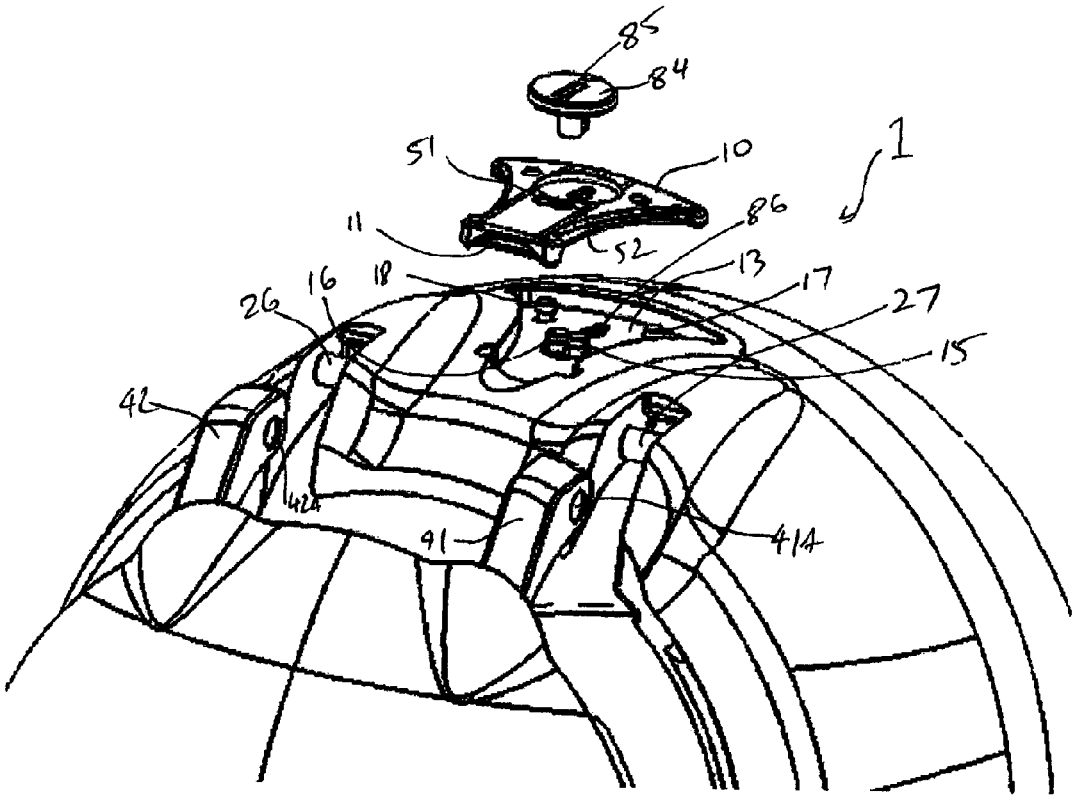
FIG. 8 illustrates components of a release tab for a helmet according to one embodiment.
Figure 9:
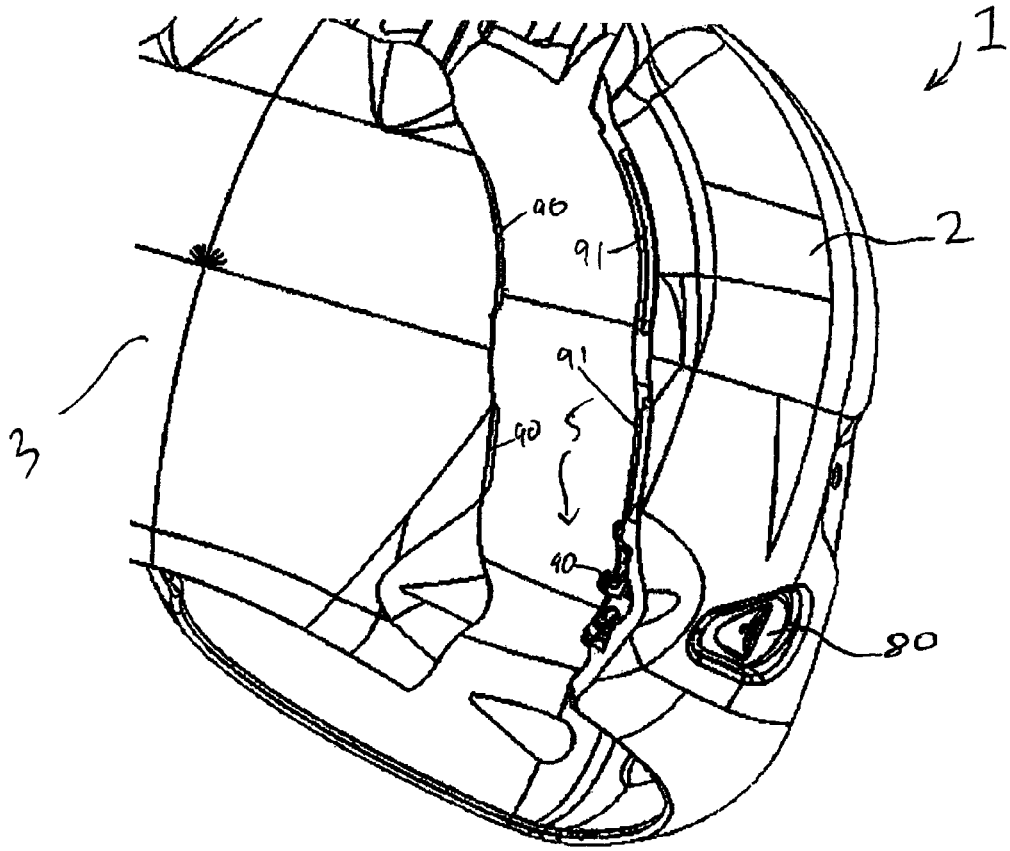
FIG. 9 illustrates a helmet according to one embodiment, shown in rear/side view with rear shell disconnected from front shell.
Figure 10:
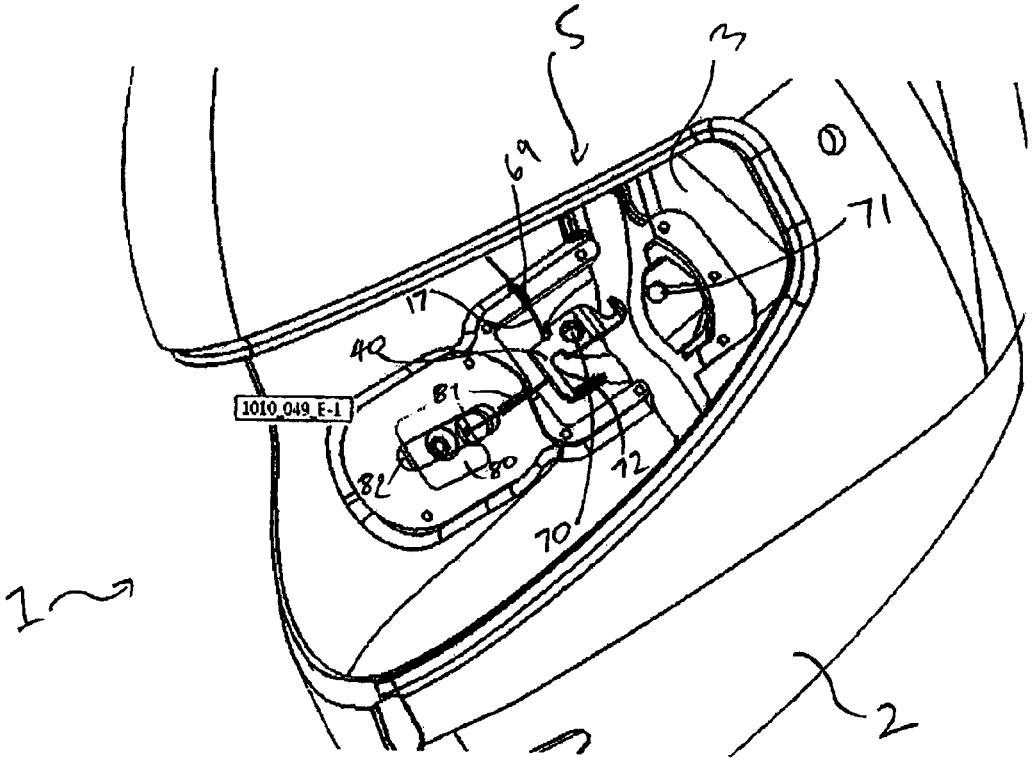
FIG. 10 illustrates a helmet according to one embodiment, shown in front/side view in an open configuration.
Figure 11:
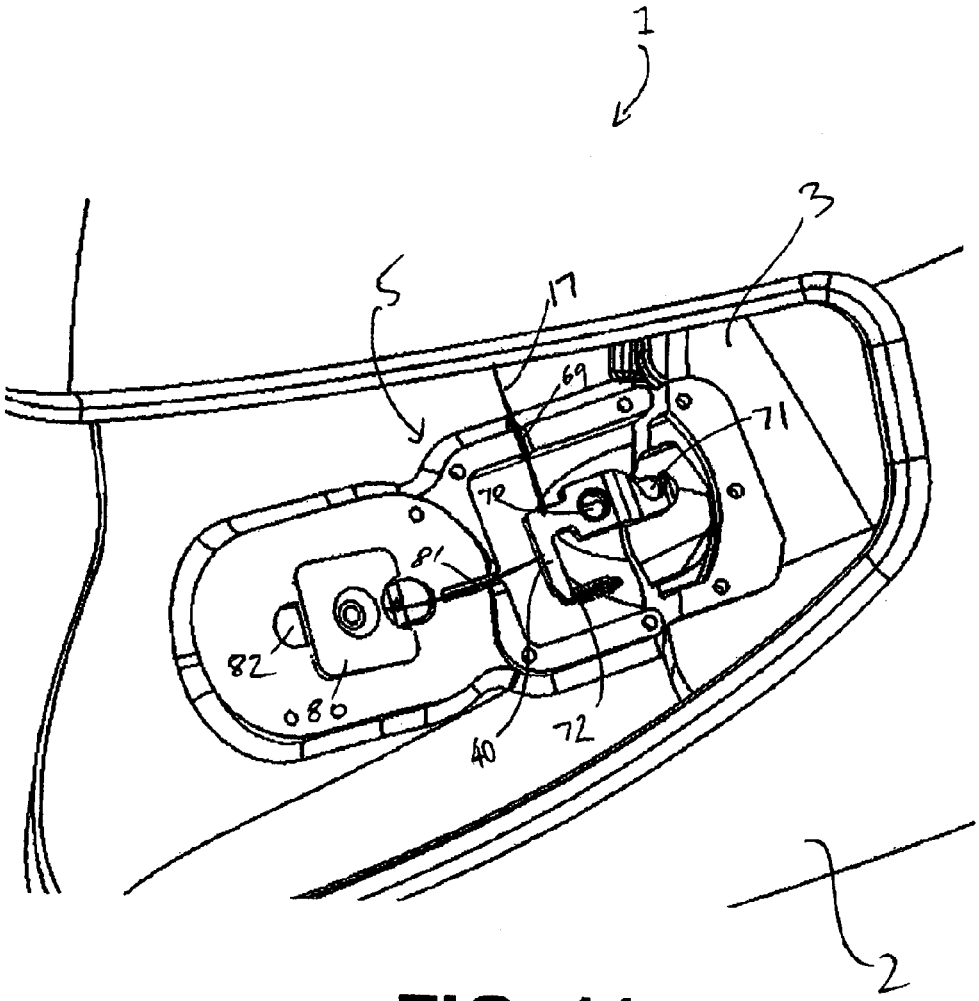
FIG. 11 illustrates a helmet according to one embodiment, shown in front/side view in a closed configuration.
Figure 12:
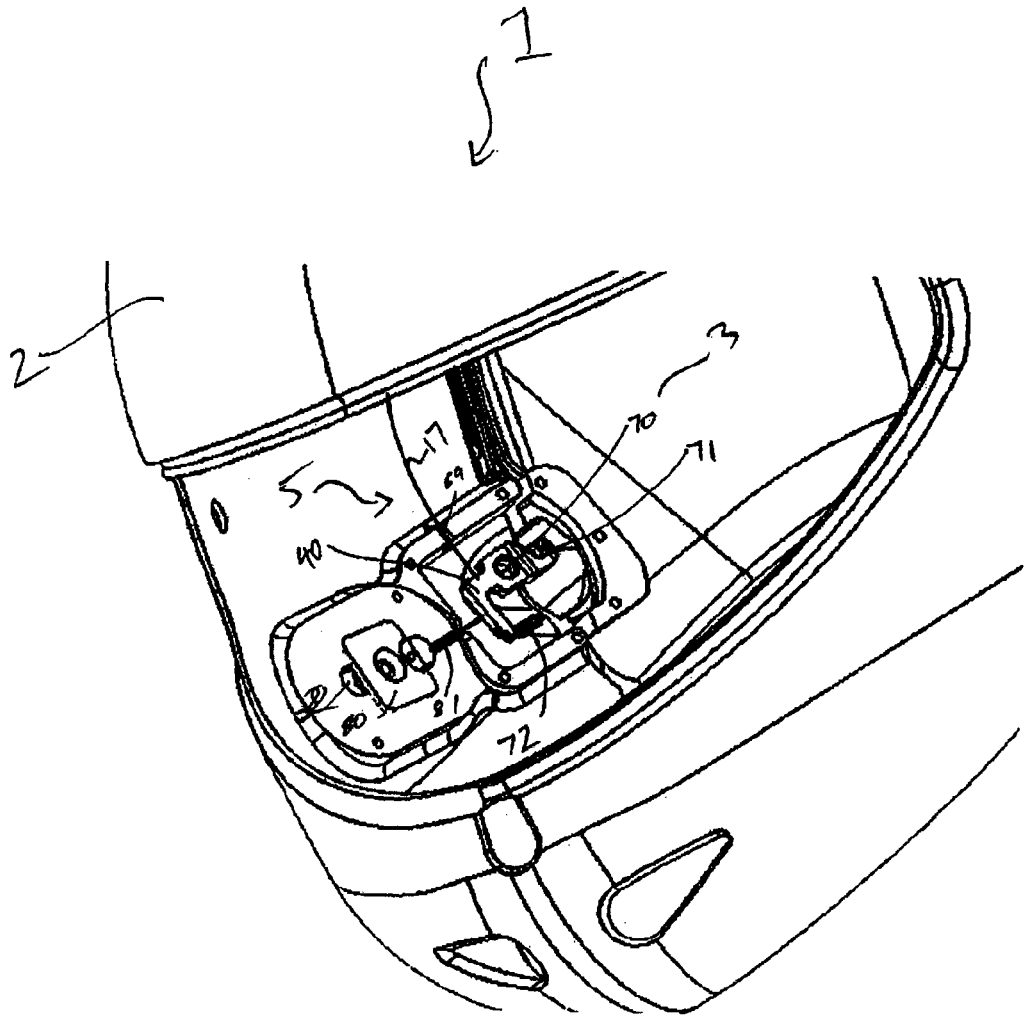
FIG. 12 illustrates a helmet according to one embodiment, shown in front/side view in a closed configuration.

Cables 15 and 16 are connected to tab member 10 to points 51 and 52 respectively. These cables then pass through a common aperture 53, along respective channels 54 and 55 and into a splitting member 27. Inside splitting member 27, cables 15 and 16 continue in oppose directions along the axis of the hinge, and axially pass respectively through coil springs 28 and 29, before terminating at hinge pins 25 and 26. As shown in FIG. 5, a threaded portion on the end of cable 15 engages with a threaded insert 49 in hinge pin 25, thereby to couple the cable to the pin.

Springs 28 and 29 resiliently bias hinge pins 25 and 26 though apertures 41A and 42A, thereby to maintain the hinged connection in place. Pulling tab member 10 correspondingly acts on cables 15 and 16, which retract and thereby act against the resilient bias of springs 28 and 29, and inwardly retracts pins 25 and 26 out of apertures 41A and 41B, thereby releasing the hinge and allowing arms 42 and 42 to move laterally away from regions 43 and 44 (thereby allowing separation of the shells).

FIG. 9 to FIG. 14 provide more detailed views of a lower side connection 5. It will be appreciated that there are a pair of lower side connections 5, and that these are mirror images of one another.

As previously discussed, cables 17 and 18 are each coupled at their distal ends to a respective movable latch member 40 of one of the lower side connections 5. These cables are respectively connected to tab member 10 at locations 61 and 62, extend through respective apertures 65 and 66 in shell 2, and along respective guide channels 65 and 66 formed in underside of recess 13 (which is designated reference numeral 14). The cables continue in mirror image fashion, with the drawings showing only cable 17. Cable 17 passes along guide channels 67 and guide channels 68 (see FIG. 14), and through a recess 69 formed at the periphery of connection 5, before terminating at a point of connection with latch 40.

Latch 40 is rotatable about a pin 70. A spring 72 resiliently biases latch 40 in the locked configuration. When closing the helmet, the leading edge of latch 40 abuts with a catch member 71, which rotates latch 40 against the resilient bias, until the helmet is fully closed at which point catch member 71 moves into a holding position on latch 40, thereby locking the helmet closed.

There are presently two means for unlocking latch 40. The first is as part of the emergency release mechanism. In this regard, it will be appreciated that pulling tab member 10 acts on cable 17 thereby to rotate latch 40 against the resilient bias of spring 72, and release catch 71 from captivity of latch 40 (hence unlocking lower side connection 5). The tension in cables 15-18 is configured such that the same degree of "pull" on tab member 40 releases both side connections and the hinge simultaneously.

The other means for unlocking latch 40 is for normal use, and involves manual manipulation of a slider 80 on each side of helmet 1. Each slider 80 is connected to latch member 40 by a cable 81, and is movable along a slider channel 82. It will be appreciated that sliding slider 80 towards the front of the helmet (i.e. away from latch 40) rotates latch 40 against the resilient bias of spring 72, and releases catch 71 from captivity of latch 40 (hence unlocking lower side connection 5). The resilient bias of spring 72 acts to maintain slider 80 at the rear end of slide channel 81 such that by default latch 40 is in the locked position.

In normal use, a user grasps helmet 1 in the open configuration, places it on his/her head, and then closes it by rotating the shells 2 and 3 together about the axis of hinge 4. Latches 40 are already in the locked position, and as noted above they engage with catch member 71 automatically upon closing of the helmet thereby to lock the helmet closed upon the shells being manipulated to the closed position without a need for additional manual intervention. To open the helmet, the user places fingers or thumbs on the two sliders 70, and slides these forward simultaneously, thereby to release latches 40 and allow the helmet to be opened.

In some embodiments, rather than providing respective manual opening devices such as sliders 70 for each side connector, a single manual opening device is provided and coupled to both. For example, in some embodiments a button is provided on the front shell, optionally proximal the chin region, this button being coupled to wires that are in turn coupled to latches 40 thereby to provide for manual simultaneous release of both latches. In some cases both approaches are implemented.

Figure 13:
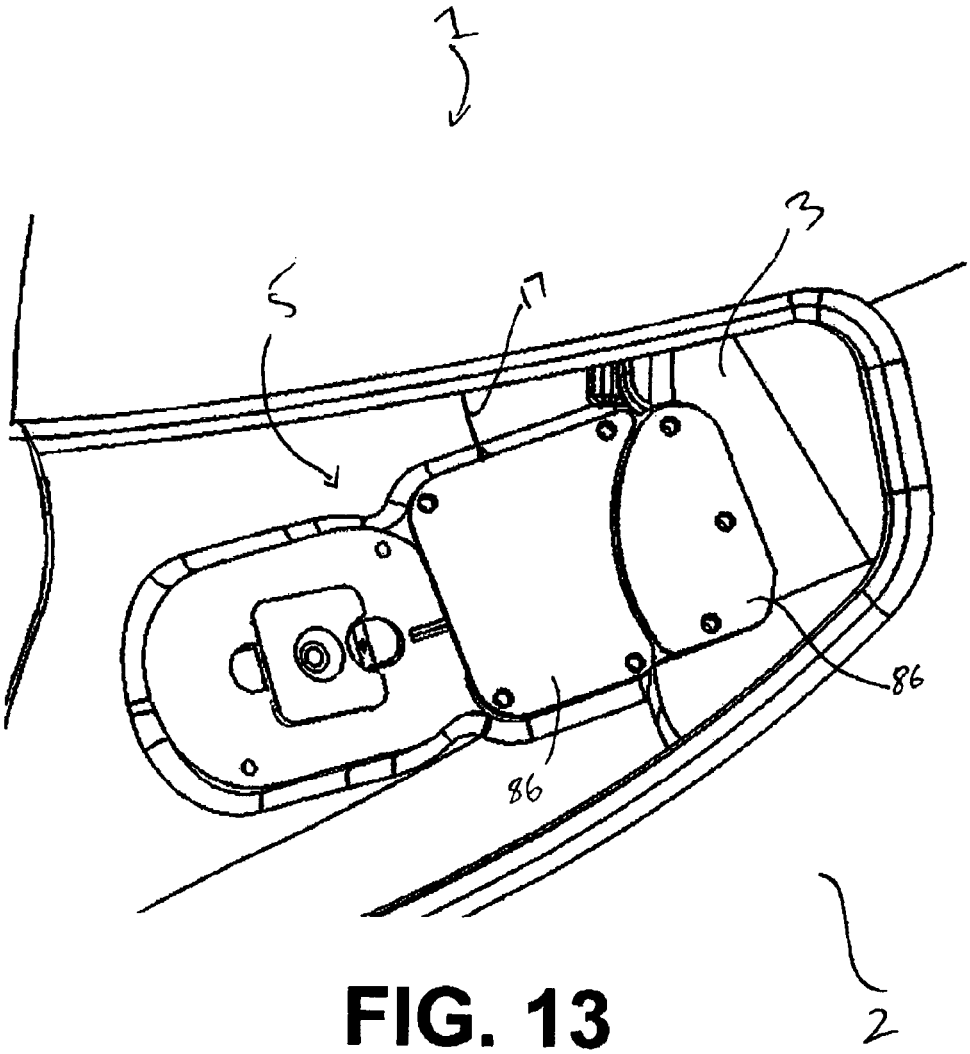
FIG. 13 illustrates a helmet according to one embodiment, shown in front/side view in a closed configuration.
Figure 14:
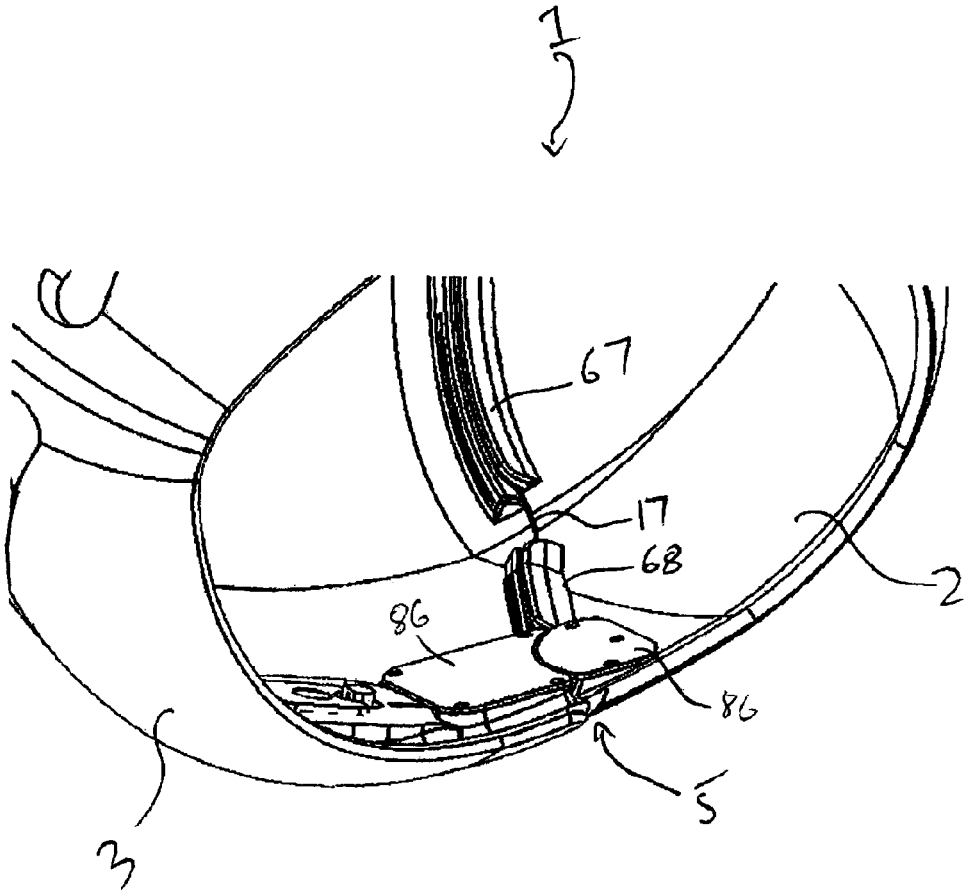
FIG. 14 illustrates a helmet according to one embodiment, shown in bottom/side view in a closed configuration
Figure 15:
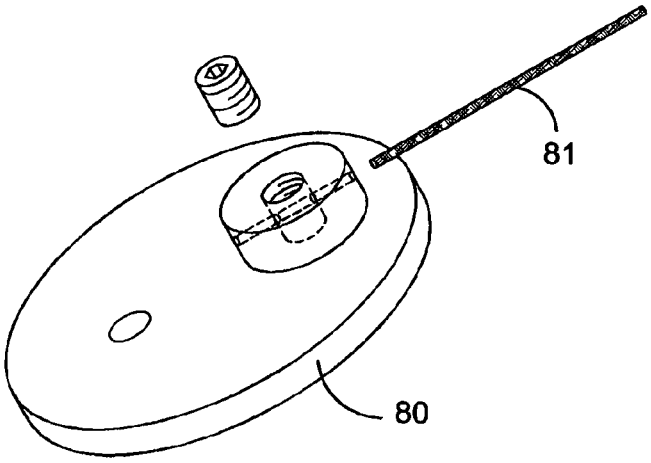
FIG. 15 illustrates a thumb release component for a helmet according to one embodiment.
Figure 24:
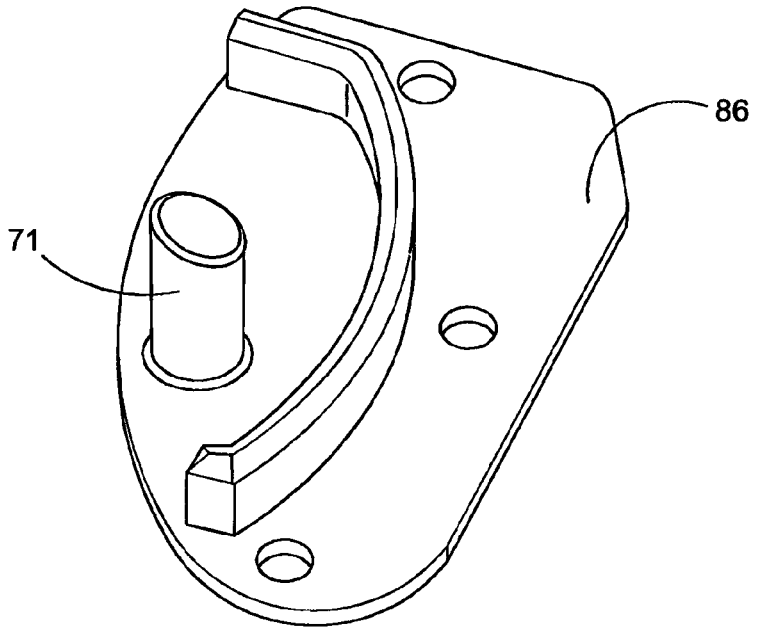
FIG. 24 illustrates a cover/catch according to one embodiment.
Figure 25A:
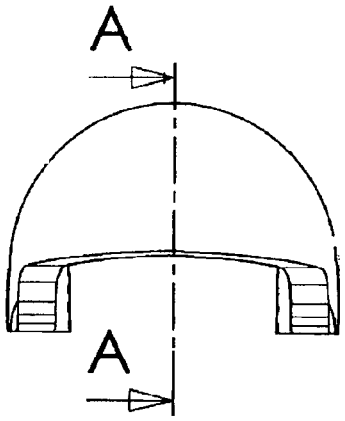
FIG. 25A-C illustrate a front shell EPS liner according to one embodiment.
Figure 25B:
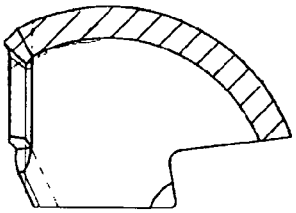
Figure 25C:
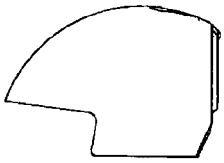
Figure 26A:
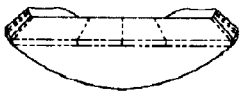
FIG. 26A-D illustrate a rear shell EPS liner according to one embodiment.
Figure 26B:
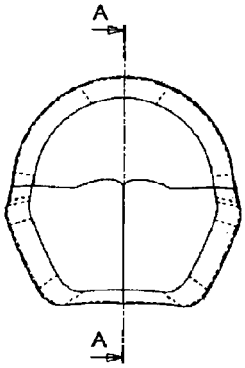
Figure 26C:
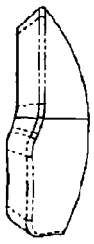
Figure 26D:
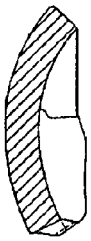

As shown in FIGS. 13 and 14, the interior of connector 5 is optionally concealed by a cover 88. In some cases catch member 71 is formed in this cover, as shown in FIG. 24.

To open the helmet in an emergency situation (for example where the wearer has been involved in an accident), tab 10 is used. Tab 10 is maintained in a secured position by a retainer 84, which is rotatably releasable thereby to permit manipulation to the tab member. In particular, retainer 84 includes a formation 85, into which an object (such as a stick, key, coin or the like) is inserted to allow rotation of retainer 84. Retainer 84 passes through a keyhole aperture 86 formed in recess 13, and is keyed such that it is only removable from aperture 86 when a key-tab 87 is in a predefined orientation. Turning retainer 84 brings key-tab 87 is in a predefined orientation. To assist in identifying that orientation, a spring (or other bias) is located under tab member 10 in recess 13, such that the tab member 10 is in normal use held in a secured position against the force of the resilient bias, and upon rotational release of the retainer to the predefined orientation the resilient bias releases retainer 84 from aperture 86 and presents the tab member in a slightly raised configuration, suited for manual manipulation of tab member 10 via a finger at location 11.

In some cases tab member 10 is configures for one-time-use only. That is, whilst it will be appreciated that the cabling arrangement described herein allows for helmet shells to be re-connected after detachment of the hinge, there are reasons for which in a practical environment that may be less than ideal. For example, following a serious accident, there may be a need to replace the helmet. Various approaches may be used to guarantee or encourage one-time-use, including the use of a sticker to cover tab member 10 (this sticker may optionally retain a key for manipulation of retainer 84), a retainer 84 that breaks upon release, and so on.

In some cases additional components are integrated into the emergency release system. For example, there are some applications where a helmet is secured to additional safety equipment, such as a support board in the case of some racing vehicles. In one embodiment the front shell is secured to such a board by additional cables coupled to tab member 10, and releasable from that board sing a similar arrangement to that used in relation to connectors 5.

In some cases the safety release mechanism bypasses the dorsal connector, and the helmet shells are held together at the dorsal connector by a removable hinge. That is, wires 17 act only on the side connectors, so actuating the safety release only releases the side connectors. In such embodiments, there are still safety advantages in the sense that the shells are separable by way of operations at the dorsal region only, albeit a first operation to remove a hinge pin, and a second operation to pull tab 10 thereby to release the side connectors.

The front and rear shells 2 and 3 of helmet 1 include respective first and second edges, wherein the first and second edges include respective complimentary inter-engaging locating formations, these locating formations being mutually locatingly engaged when the helmet is in the closed configuration to substantially transversely locate the front shell with respect to the rear shell. The locating formations are defined at one or more locations by the cross-sectional profiles of the first and second edges. Specifically, the rear shell includes tabs 90 which locate in recesses 91 on the front shell. Various other approaches for providing such an interlocking edge are discussed further above, and in PCT/AU2006/001770, and it will be appreciated that any of those could be substituted into helmet 1 (or other embodiments described herein).

FIG. 38 to FIG. 42 illustrate a further embodiment similar in function to that of FIGS. 1 to 15, and some (but not all) corresponding features have been designated corresponding reference numerals. Those skilled in the art will readily recognise many corresponding features between the embodiments. However, at a general level, FIG. 38 to FIG. 42 relate to a rear-opening helmet 200 having a front shell 201 and a rear shell 202. These shells are optionally formed of fibreglass, carbon fibre, composite materials, or the like. Inserts assemblies are mounted to the shells thereby to provide for locking members, safety release, and so on. These are formed separately of the helmet shells. There is an upper insert assembly 203, and two lower insert assemblies 204 (which are mirror images of one another). Insert assembly 203 is mounted to the front shell. Plate 211 of insert assembly 204 is mounted to the front shell, and plate 212 (which carries catch 71) mounted to the rear shell. Mounting may be achieved by adhesives, rivets, or the like. Each insert assembly 208 includes a member 208 to which a respective side of an adjustable chin cup is connected.

FIG. 16 to FIG. 20 illustrate design options for a chin cup to be used in a rear opening helmet such as helmet 1, which may be used for various embodiments of rear opening helmets.

Figure 16:
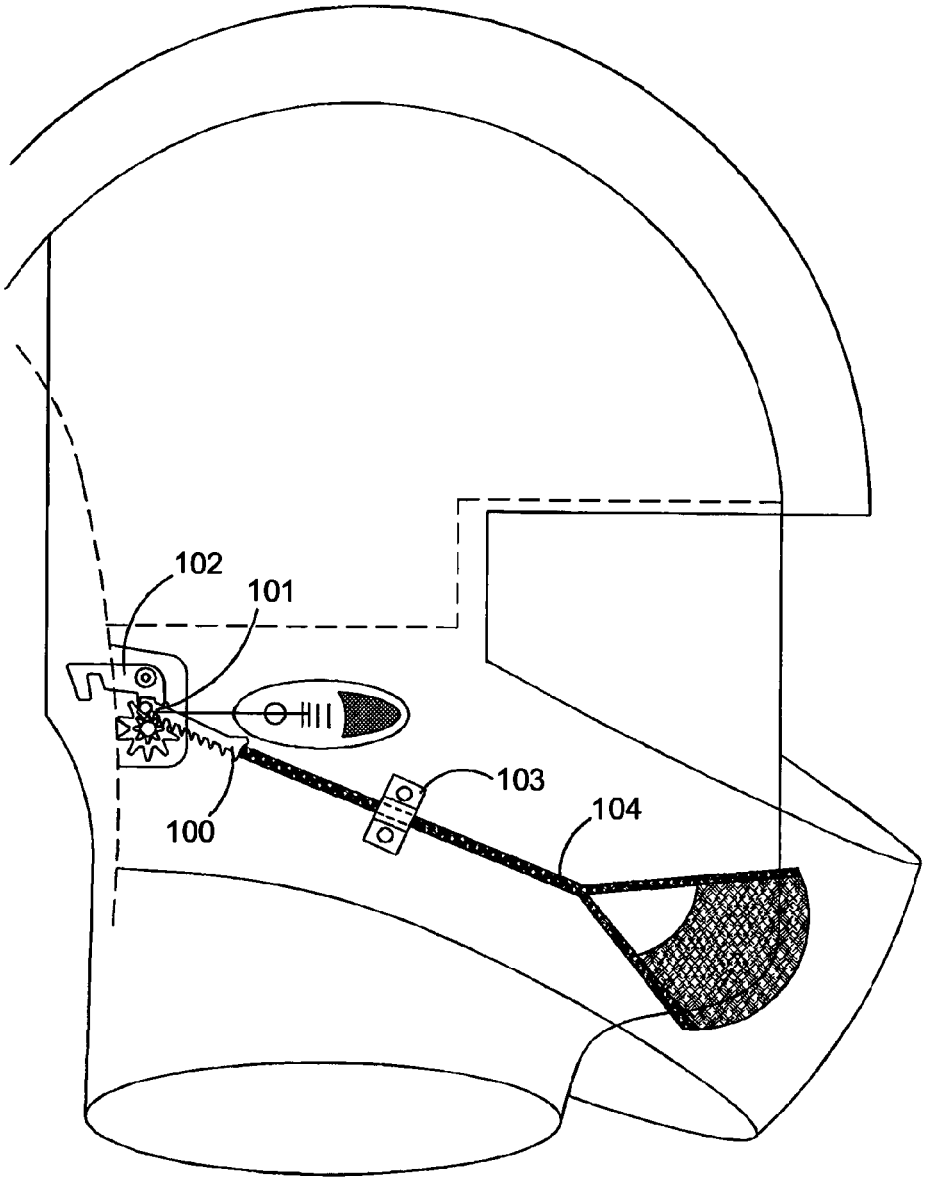
FIG. 16 illustrates a helmet according to one embodiment, shown in side view.

In the case of FIG. 16, a chin cup strap 104 has a cam or gears at the end connected to the helmet shell. The strap slides through a guide 103, and has a cam or gear section 100 it its distal end. Section 100 interacts with a geared friction roller cam 101, thereby to allow the chin cup to move forward and/or backward when the helmet is open, but lock into position when the helmet is closed subject to the operation of locking hook 102.

Figure 17:
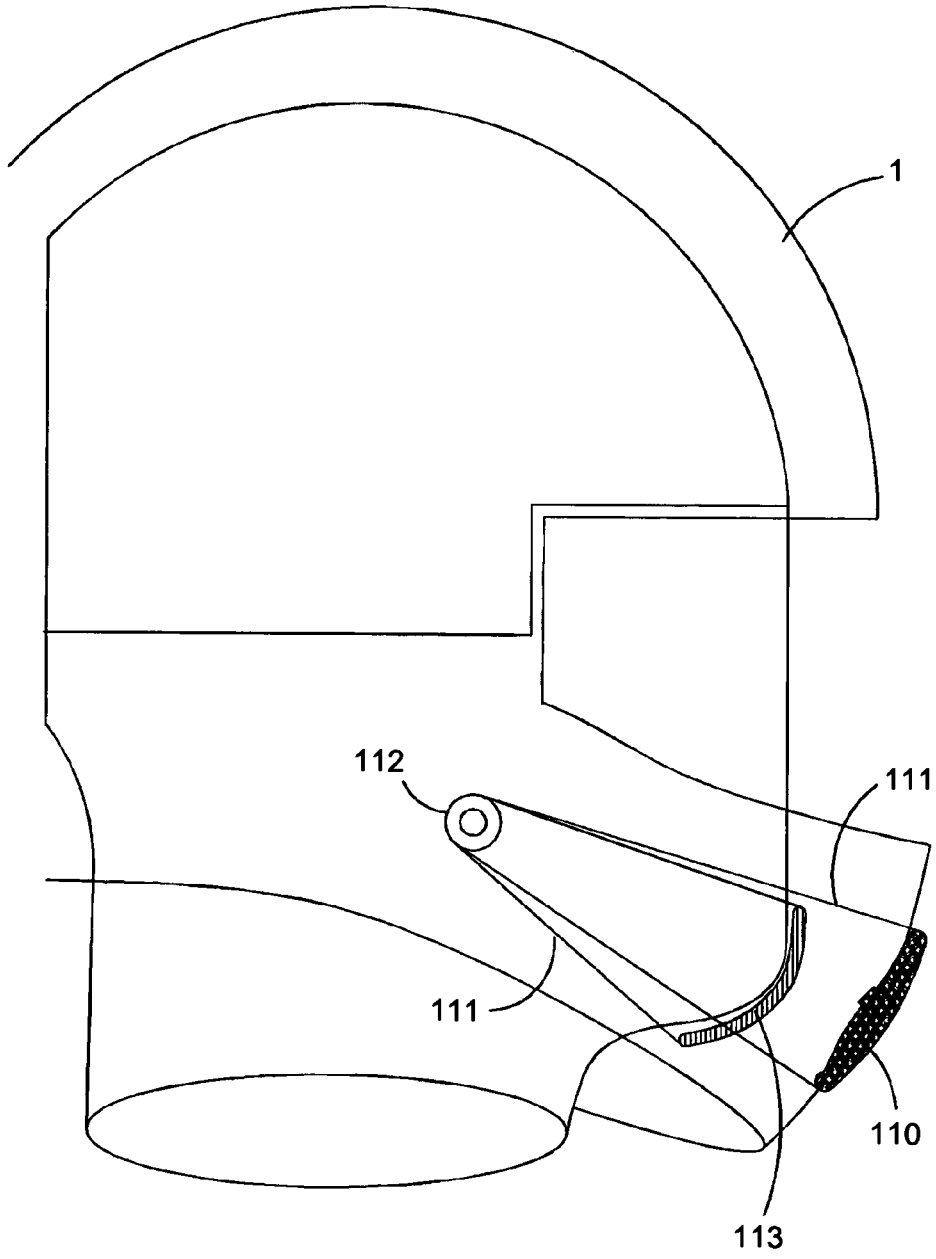
FIG. 17 illustrates a helmet according to one embodiment, shown in side view.

The example of FIG. 17 includes a windable cable cam 100 at the chin region of the helmet, which is wound to tighten/loosen a cable 101 which, via a pulley 102, adjusts the position of chin cup 103. Accordingly, turning cam 100 adjusts helmet fit by adjusting the chin cup.

Figure 18:
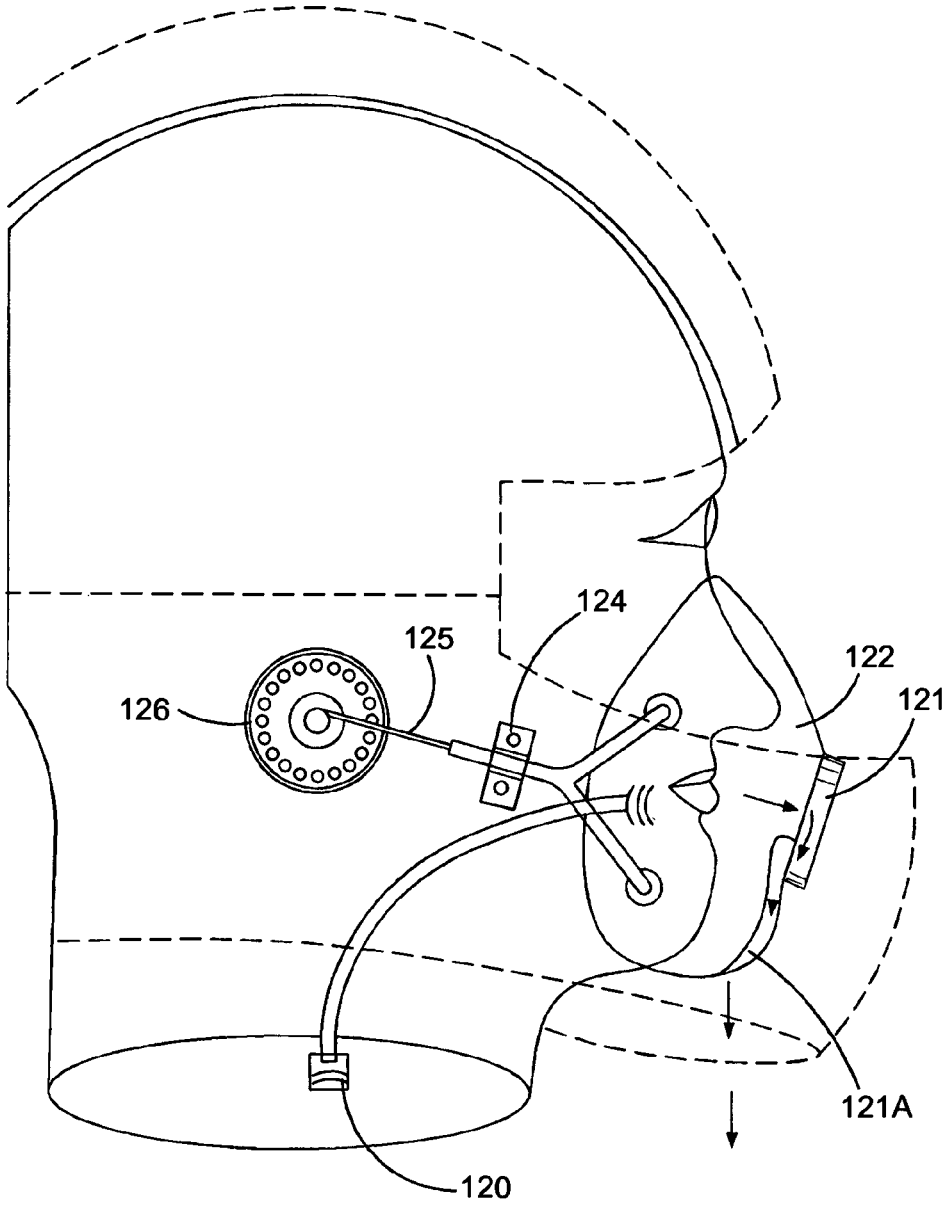
FIG. 18 illustrates a helmet according to one embodiment, shown in side view.
Figure 19:
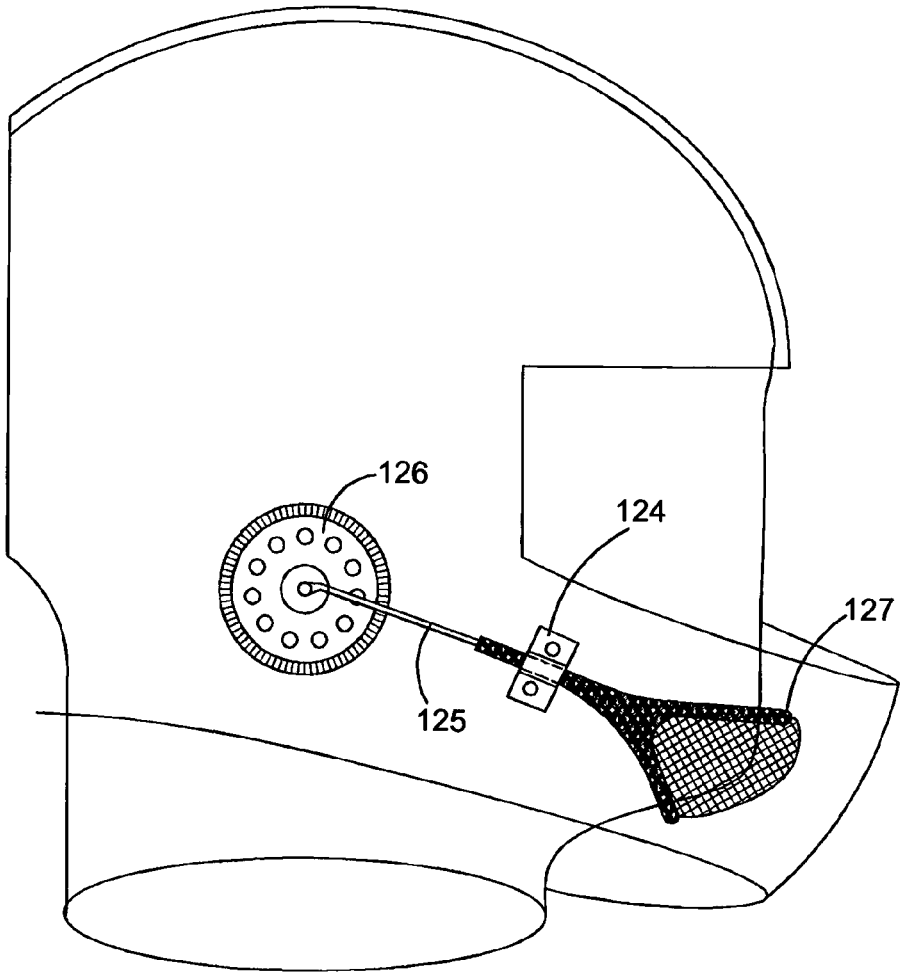
FIG. 19 illustrates a helmet according to one embodiment, shown in side view.

FIG. 18 illustrates a helmet including a breathing apparatus integrated into the chin cup. An air inlet line 120 provides fresh air to a wearer, and a one-way valve 121 in a breathing mask 122 expels air (for example exhaled air) via an aperture 121A. Side mounts 124 allows mask 122 to move, and a cable 125 combines with a windable tightening mechanism 126 to allow size adjustment. Chin cup 127 of FIG. 19 uses a similar sizing arrangement.

Figure 20:
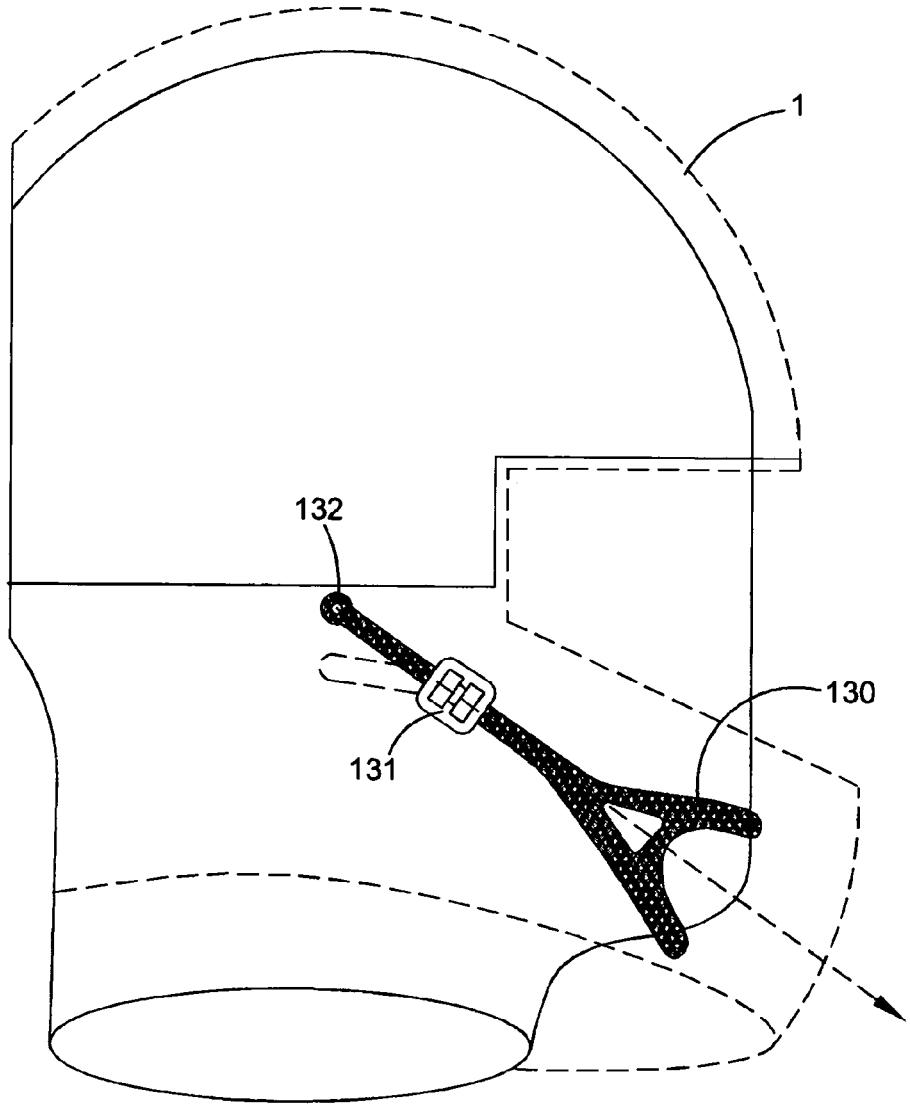
FIG. 20 illustrates a helmet according to one embodiment, shown in side view.
Figure 21:
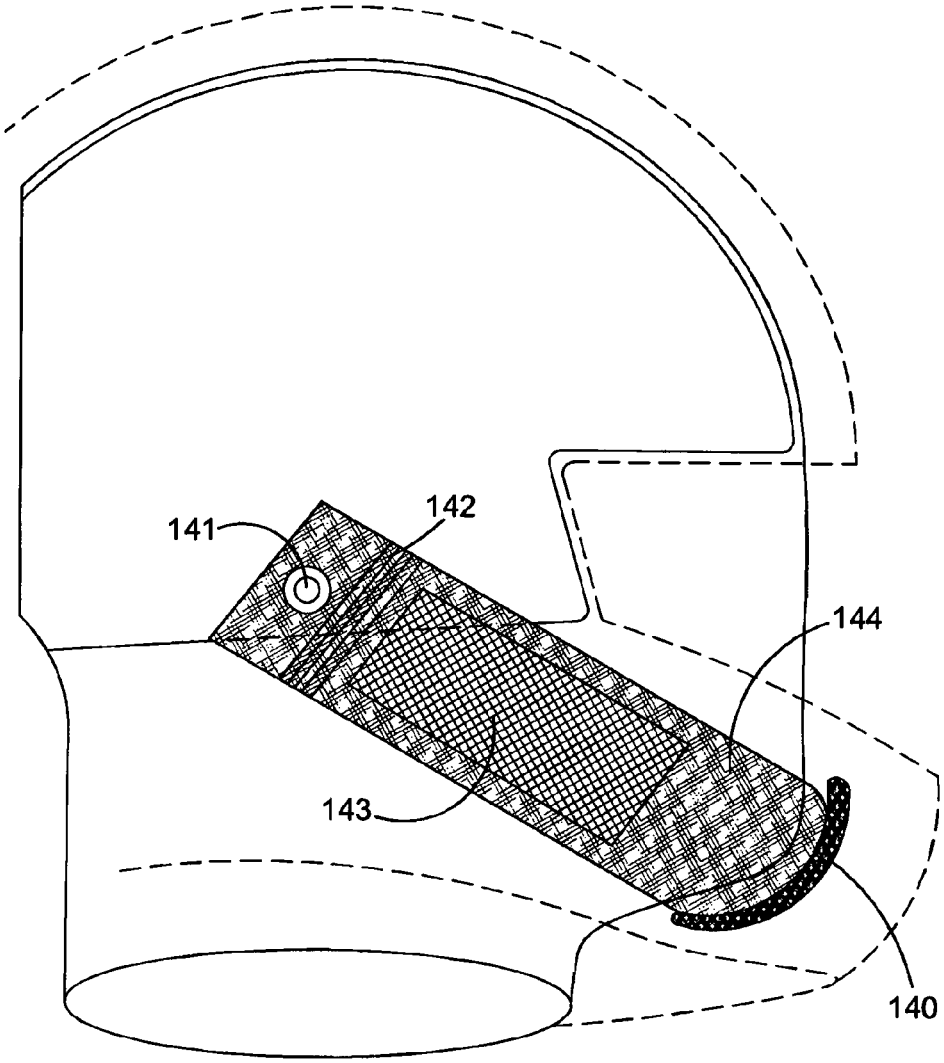
FIG. 21 illustrates a helmet according to one embodiment, shown in side view.
Figure 22:
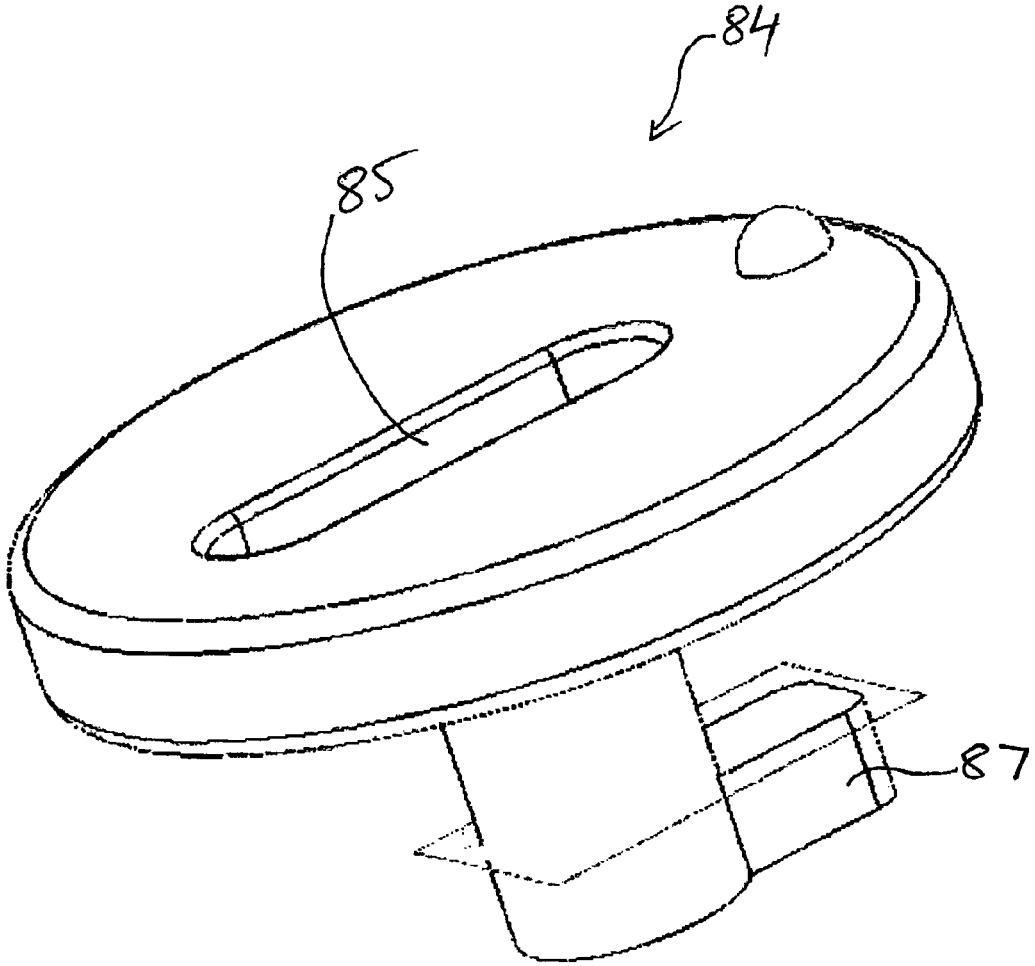
FIG. 22 illustrates a retaining member according to one embodiment.
Figure 23:
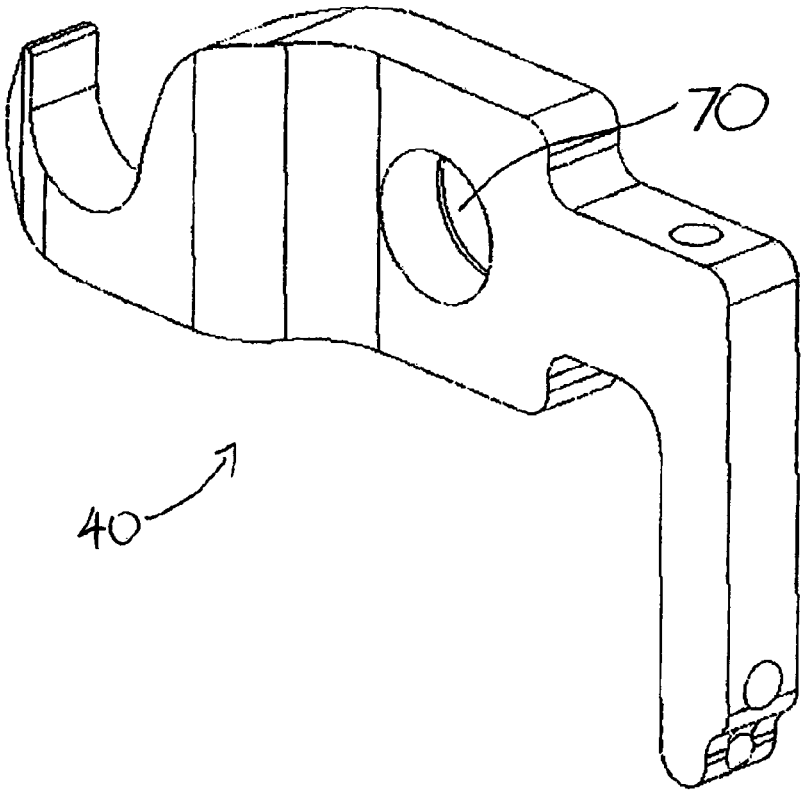
FIG. 23 illustrates a latch according to one embodiment.

In the case of FIG. 20, a chin cup 140 is size adjustable using a buckle 131, with a strap being connected to the helmet at a rivet point 132. FIG. 21 illustrates another option making use of a chin cup 140 that is size adjustable using Velcro portions 143 and 144, with some elasticity due to an elastic section 142. Again, the strap is connected via a rivet point 141.

Figure 27:
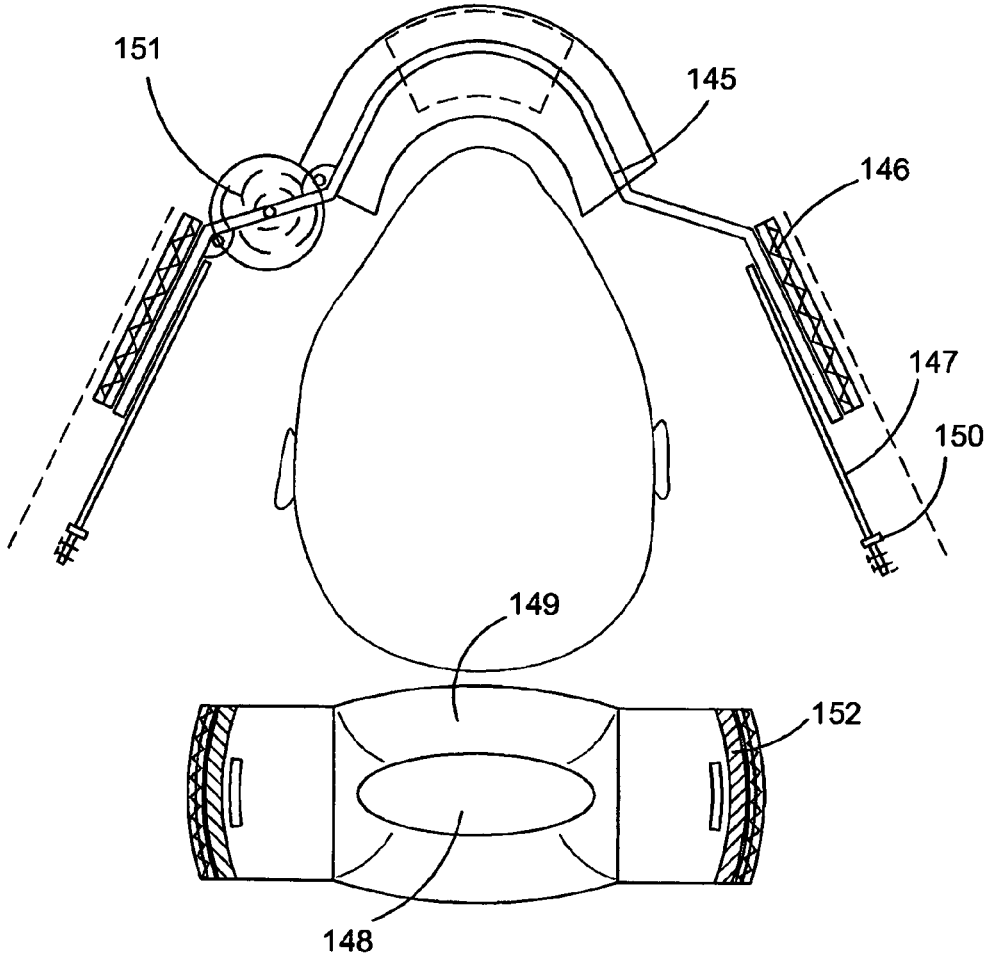
FIG. 27 illustrates helmet according to one embodiment, shown as a sectional view from above.
Figure 28:
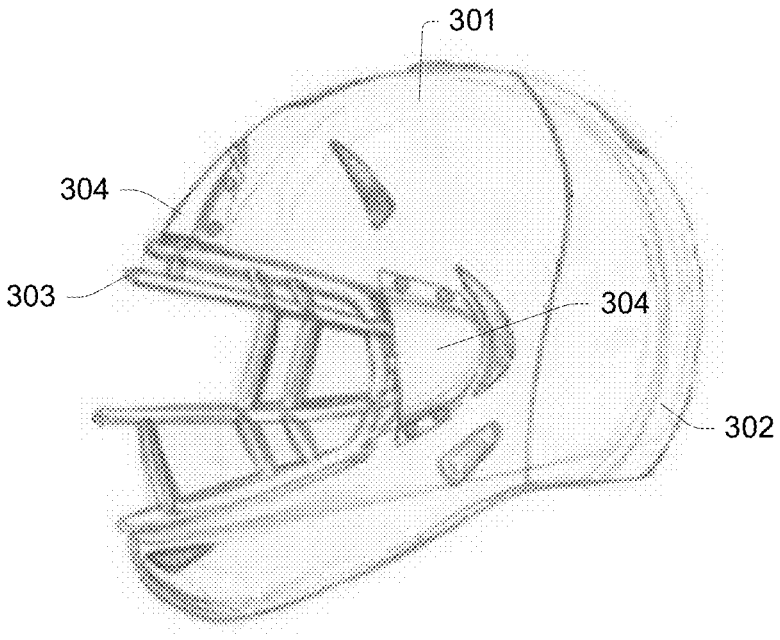
FIG. 28 to FIG. 35 illustrate embodiments configured for use in sports including American football.
Figure 29:
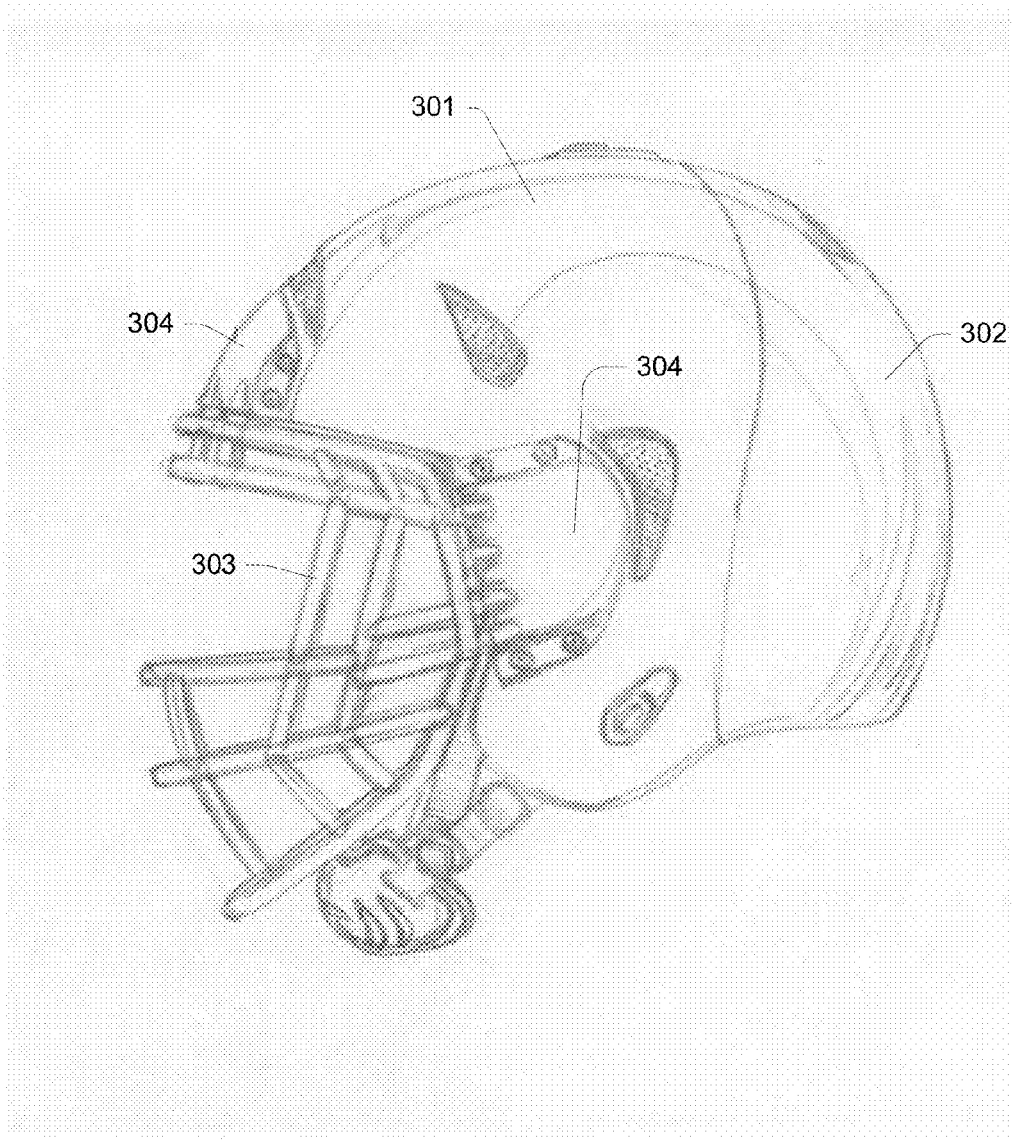
Figure 30:
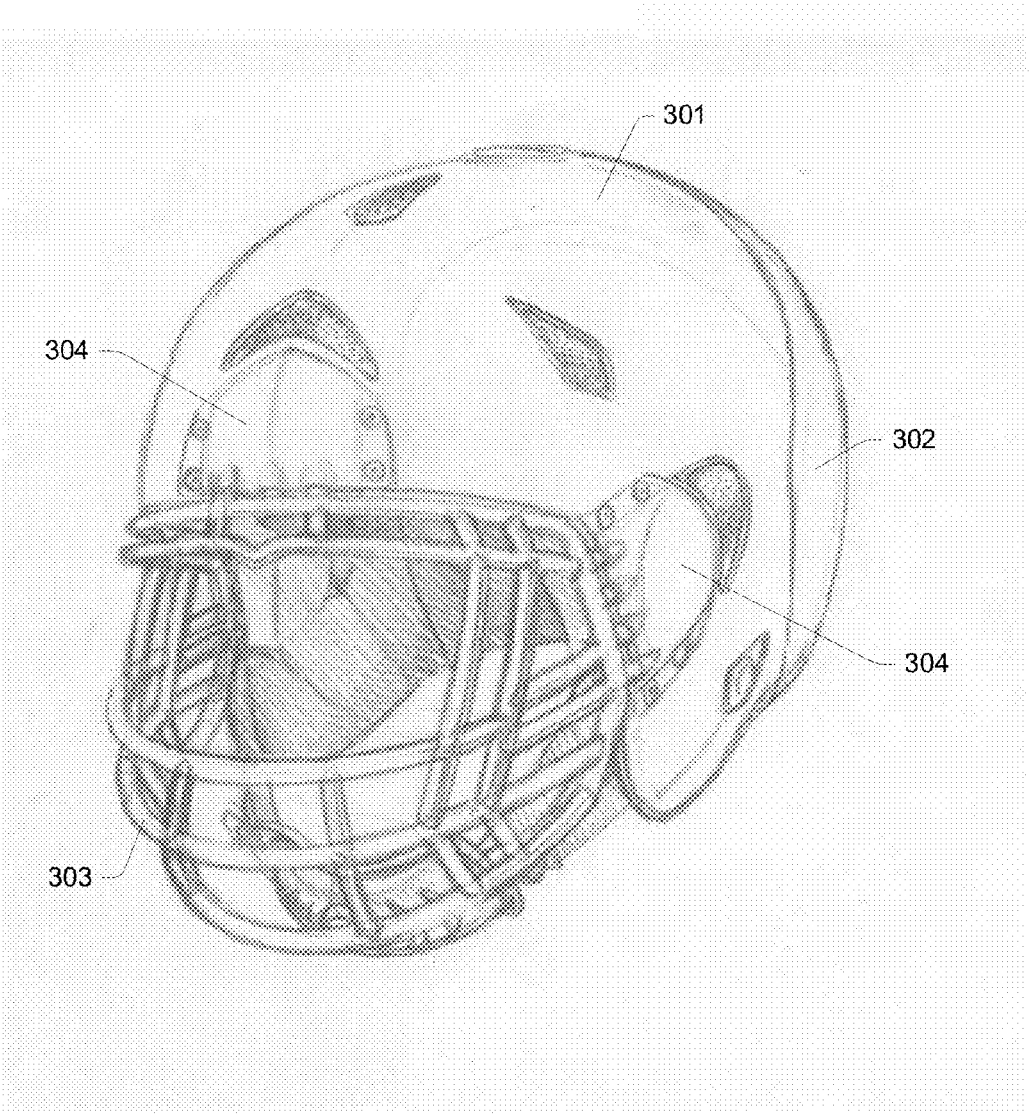
Figure 31:
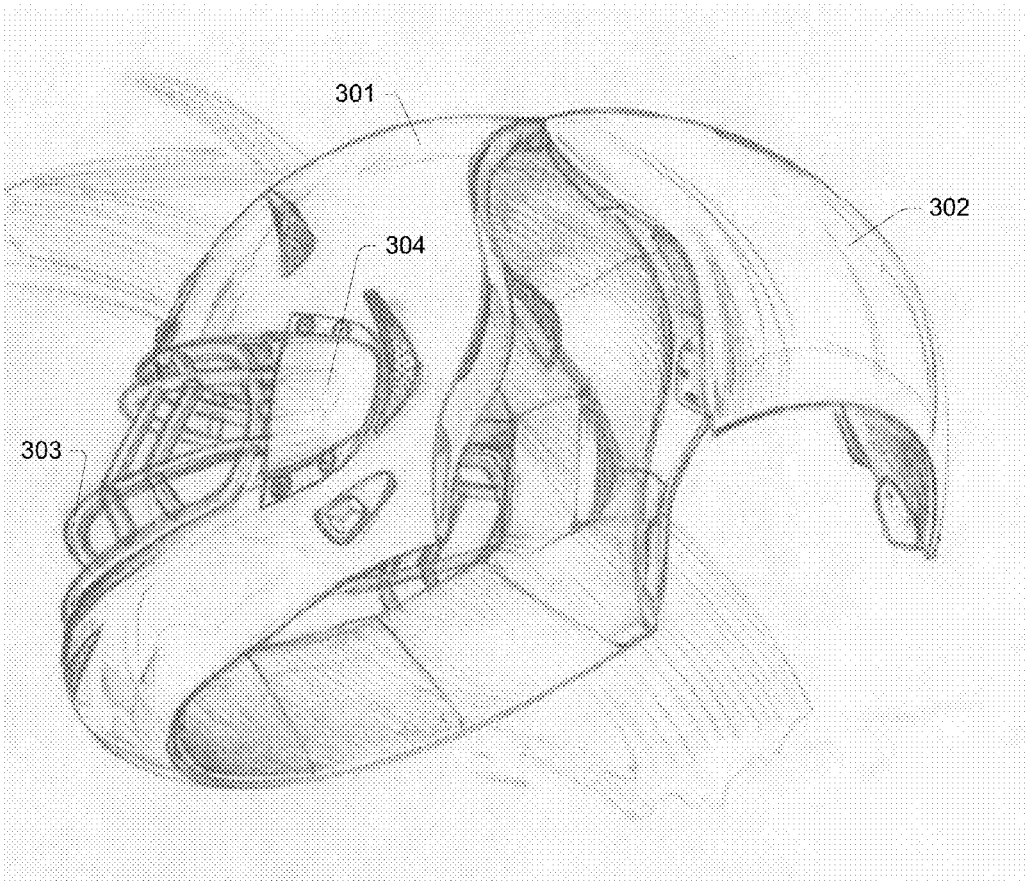
Figure 32:
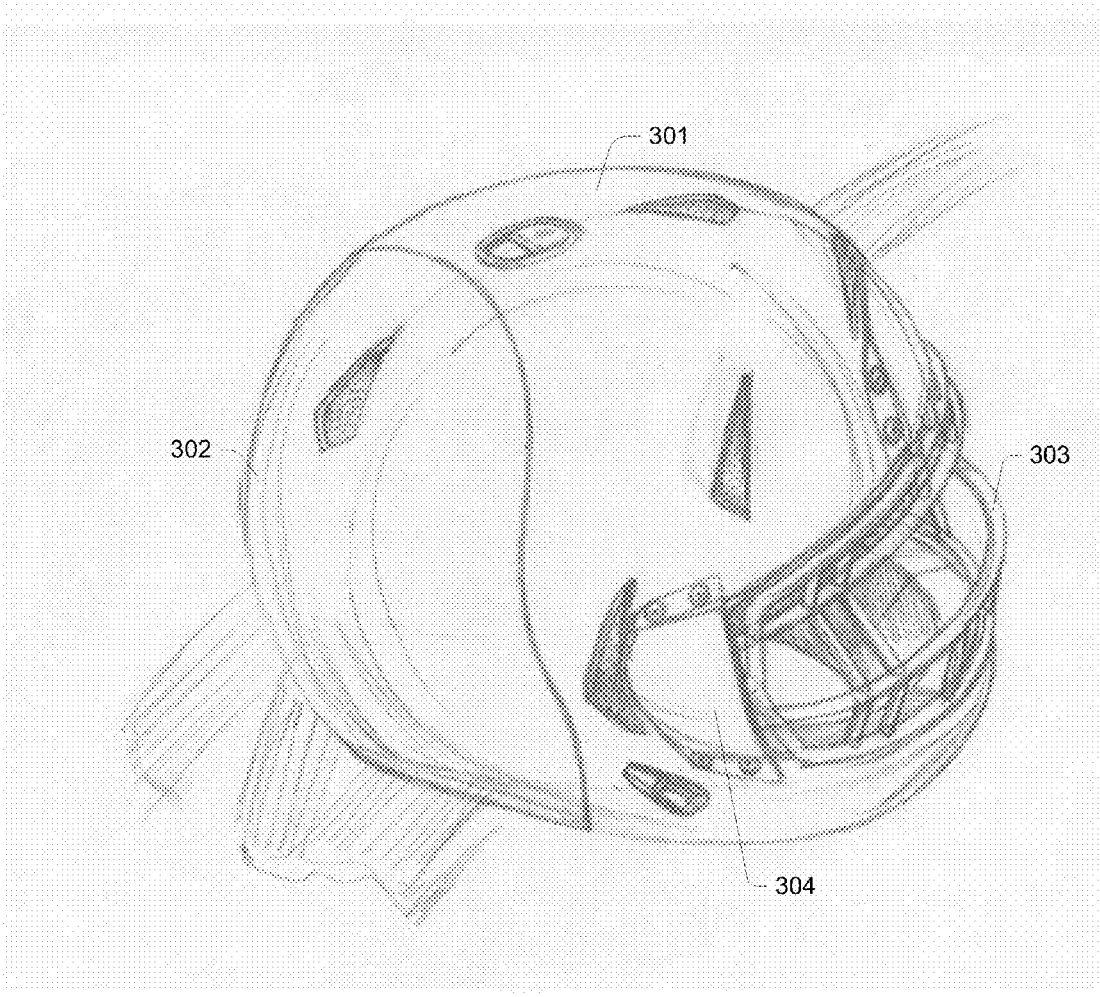
Figure 33:
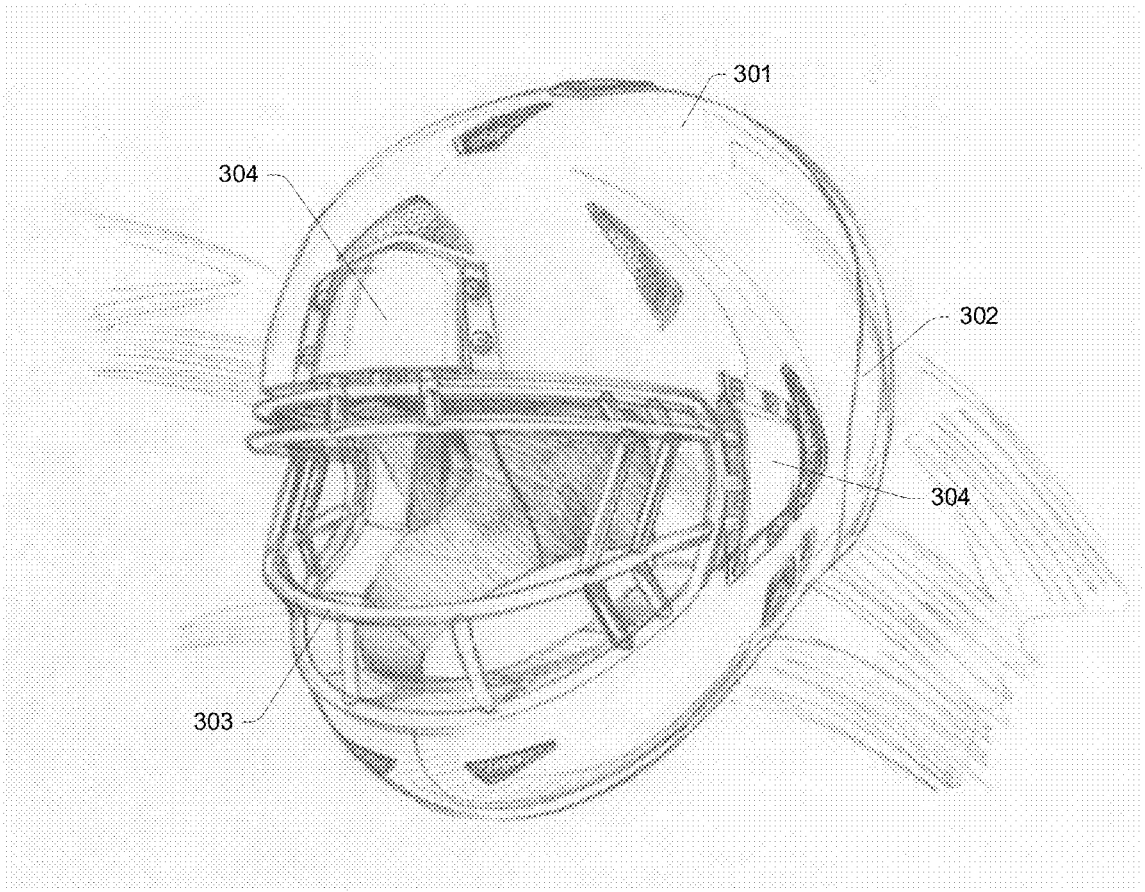

FIG. 27 illustrates a further embodiment having a flexible chin cup 145. This chin cup is moulded and designed thereby to provide a flexible shock absorbent offset. Industrial Velcro 146 is used, with one half is mounted on the helmet the other on a chin cup side extension. A flexible mounting strap 147 screws on to the flexible chin cup side extension. This allows the chin cup to be adjustable but still mounted to the helmet. A chin cup vent hole and chin retainer 148 aligns the chin for the fitting point when applying the helmet. Shaped confront padding 149 is attached to the chin cup. A strap mount-attachment bracket 150 is riveted to the helmet. A shock absorbent-flexible offset 151 allows the chin cup to flex when force is applied externally to take up some of that force. As shown at 152, moulding is used to curve side extensions to fit the contour of the inner of the helmet to mount the chin cup.

FIG. 28 to FIG. 35 show further embodiments of a rear opening helmet, configured primarily for use in American football and other similar activities. These optionally make use of safety release technology described above, however these embodiments should not be necessarily restricted to requiring such technology.

In overview, a rear opening helmet configured for activities such as American football a front shell 301 having a primary vision aperture formed therein, and a rear shell 302 hingedly movable with respect to the front shell. This provides an open configuration in which the helmet is able to be placed on a user's head or removed from the user's head, and a closed configuration wherein the rear shell is releasably lockingly engaged to the front shell. In some cases the front and rear shells are configured such that, when in the closed configuration, the helmet is configured for securely containing the head via a closure boundary defined by respective edges of the front and rear shells (that is the helmet cannot be removed when closed). However, that is not in all cases necessary (take for example the embodiment of FIG. 29 and FIG. 30).

A protective cage assembly, including a protective cage 303, overlies the primary vision aperture. A protective cage mounting assembly is provided, this being formed of resilient material. The protective cage mounting assembly is mounted intermediate the protective cage assembly and the front shell such that the resilient material allow limited damped movement of the protective cage assembly with respect to the front shell. By way of this mounting assembly, the protective cage is connected to the front shell via a form of shock absorber system. This allows some resilient movement of the chin guard with respect to the helmet shell.

The shock absorber system may include the use of resilient materials (such as rubber), these resilient materials coupling the cage (which is presently titanium, but may be formed of other materials) to the helmet shell. For example, in the illustrated embodiment a recess is formed in the main shell, and this recess is used to house a resilient material such as rubber or polyurethane into which the cage is mounted. The cage assembly also includes one or more covers 304, which is/are then applied over the recess and resilient material.

Figure 34:
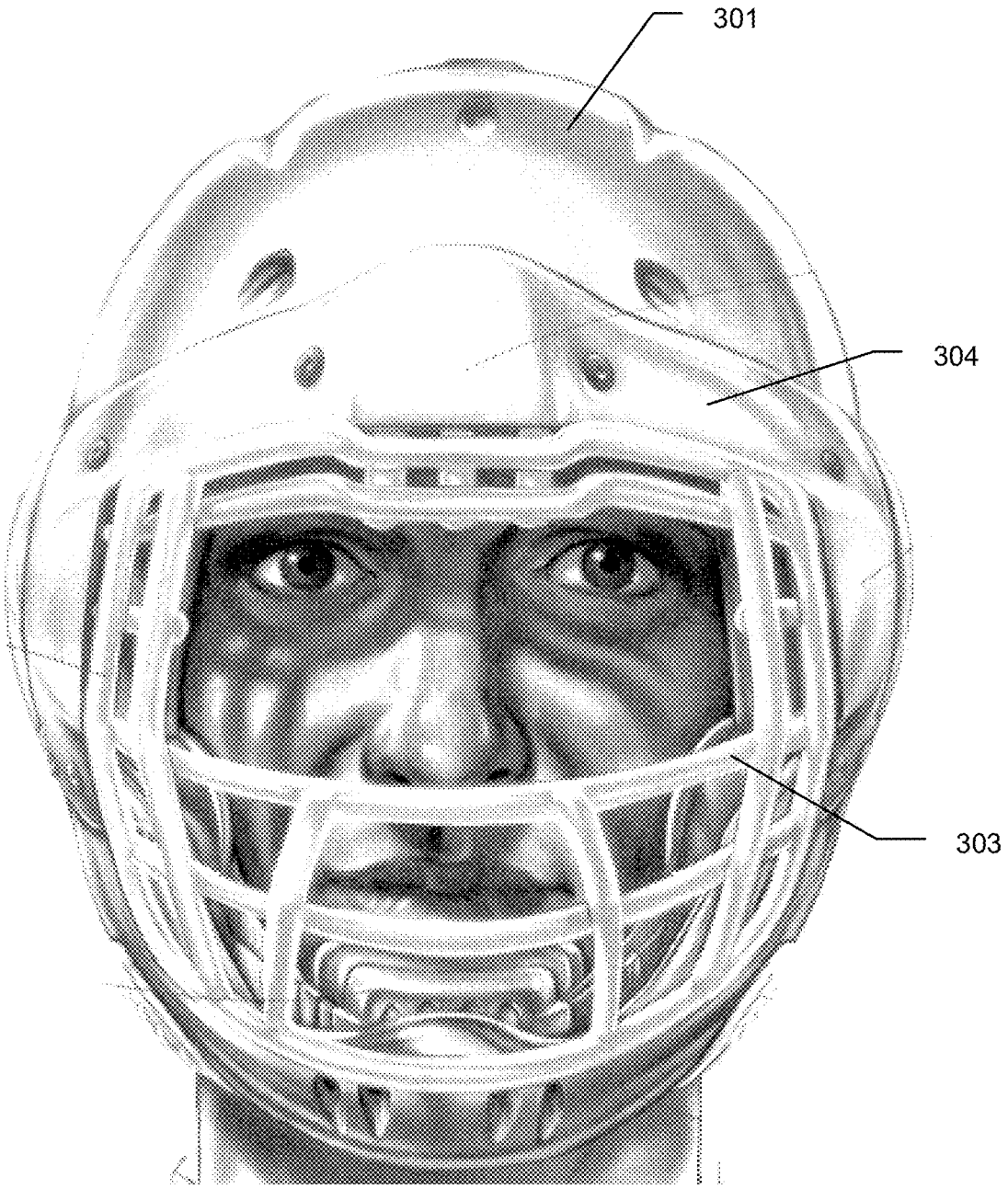
Figure 35:
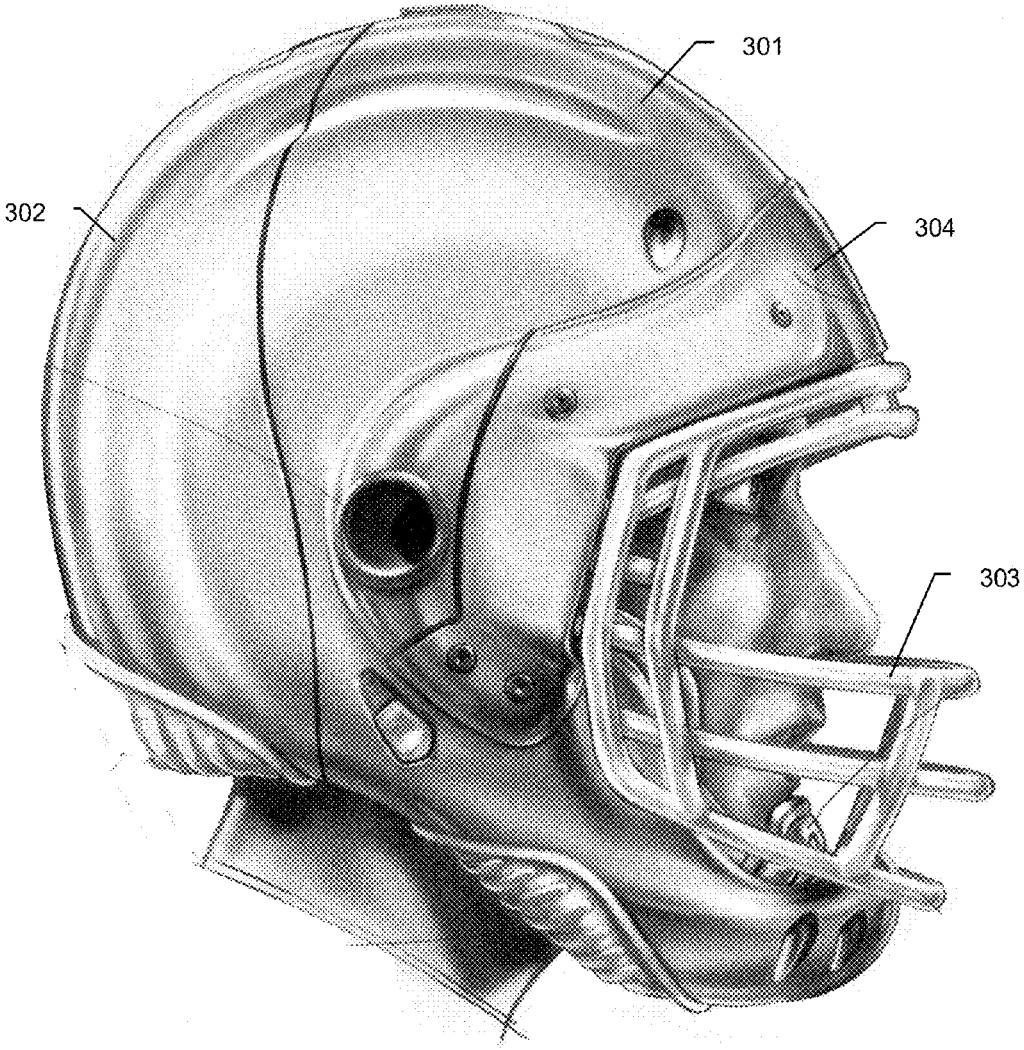
Figure 36:
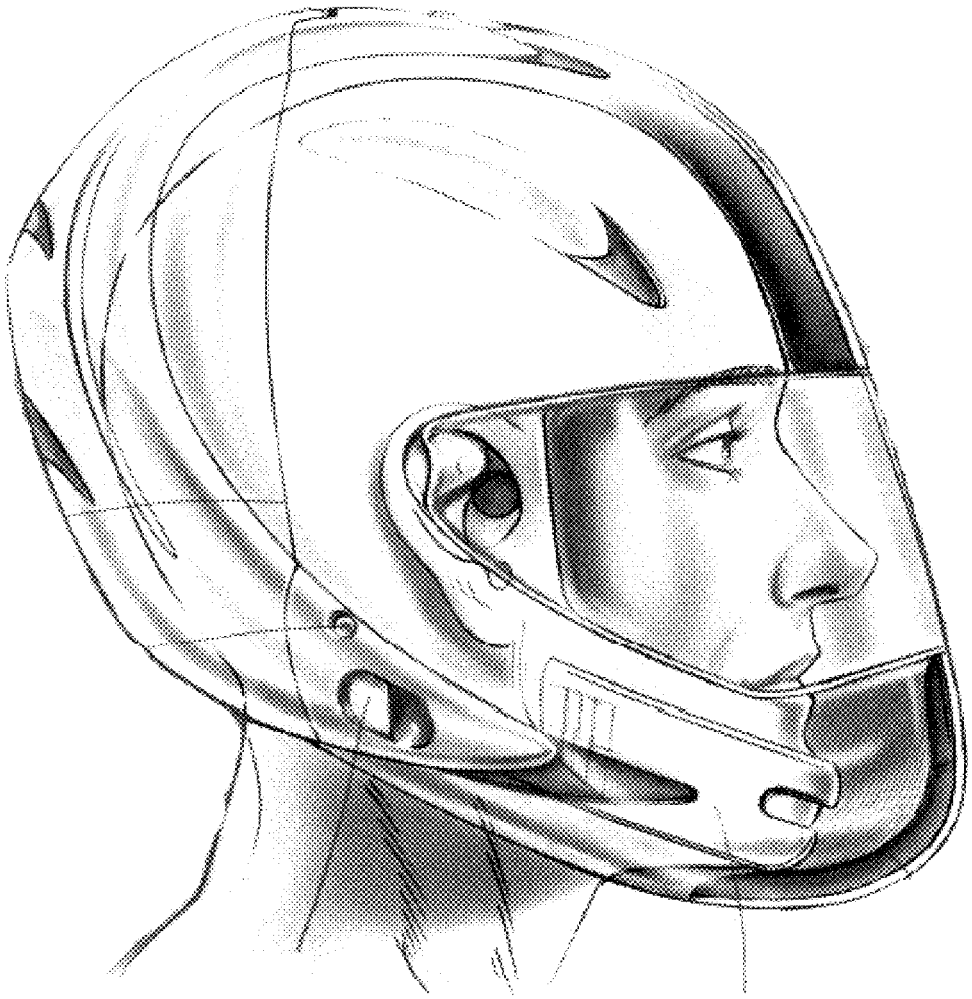
FIG. 36 illustrates a helmet according to one embodiment.
Figure 37:
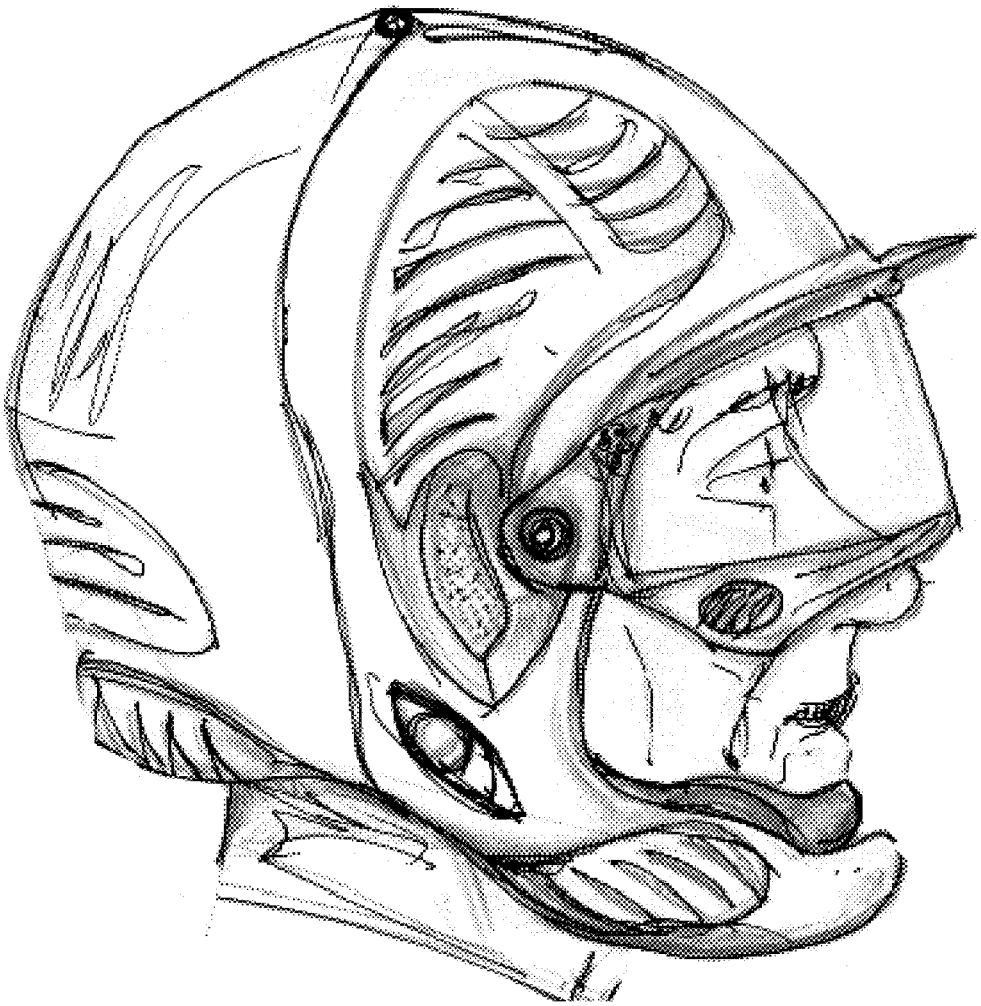
FIG. 37 illustrates a helmet according to one embodiment.
Figure 38:
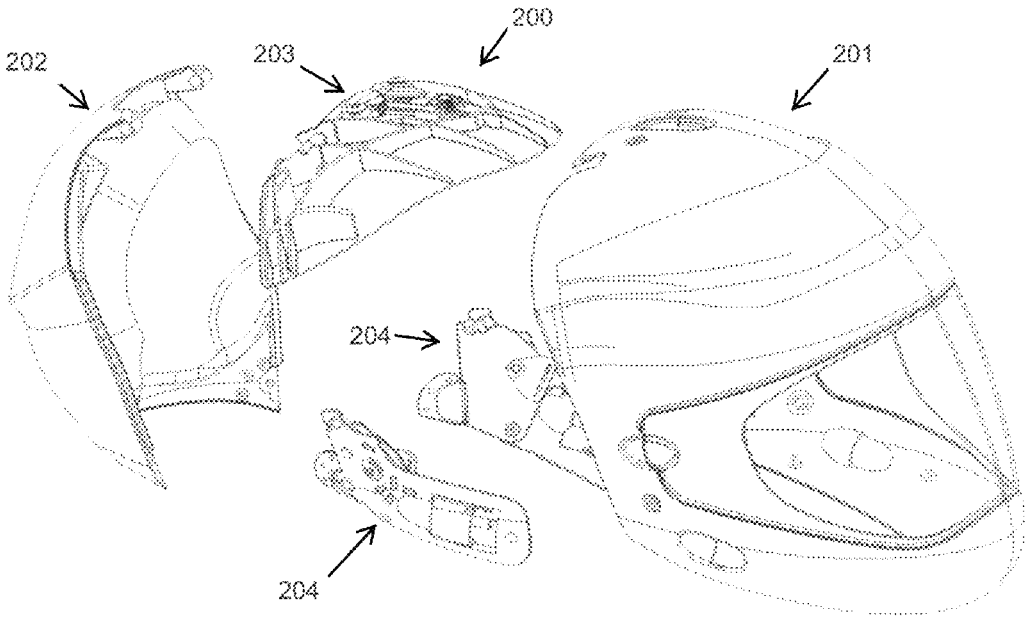
FIG. 38 to FIG. 42 illustrate an embodiment making use of insert assemblies thereby to provide for a safety release mechanism.
Figure 39:
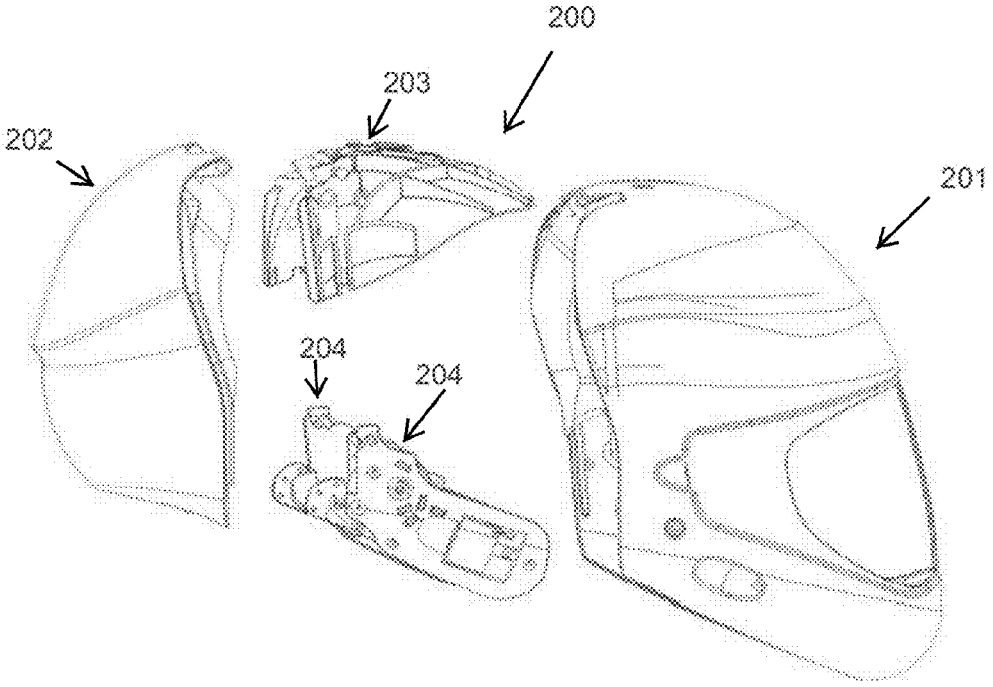
Figure 40:
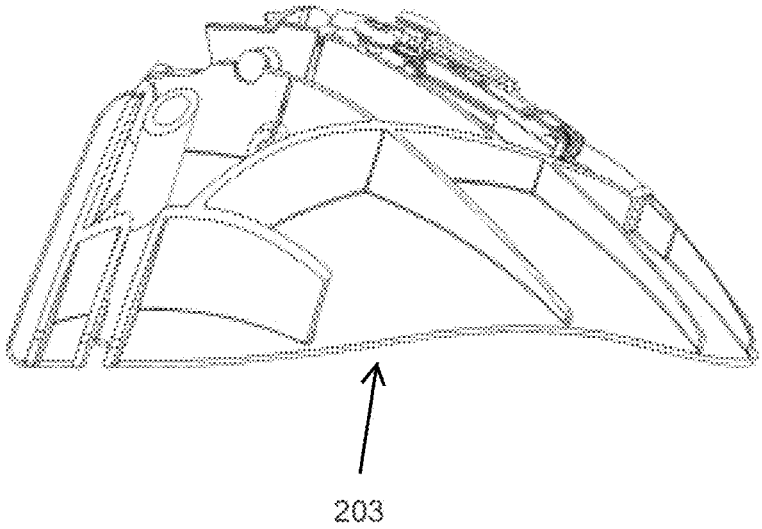
Figure 40:
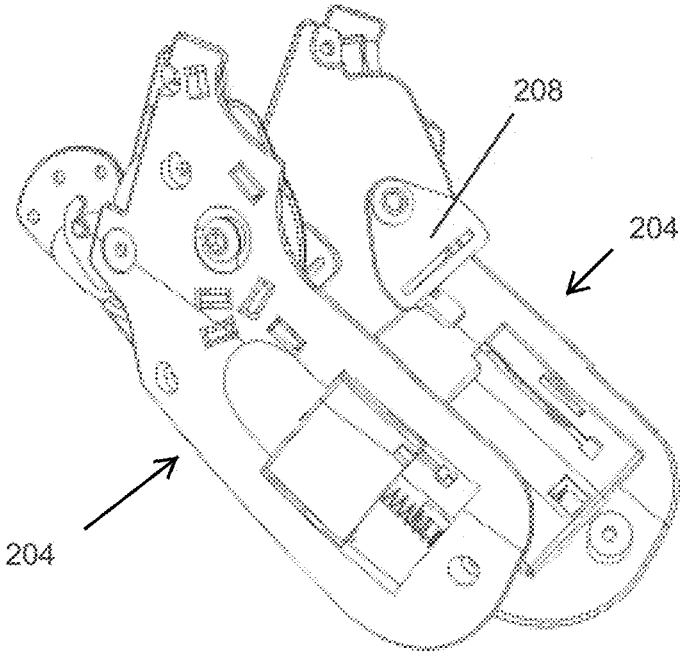
Figure 41:
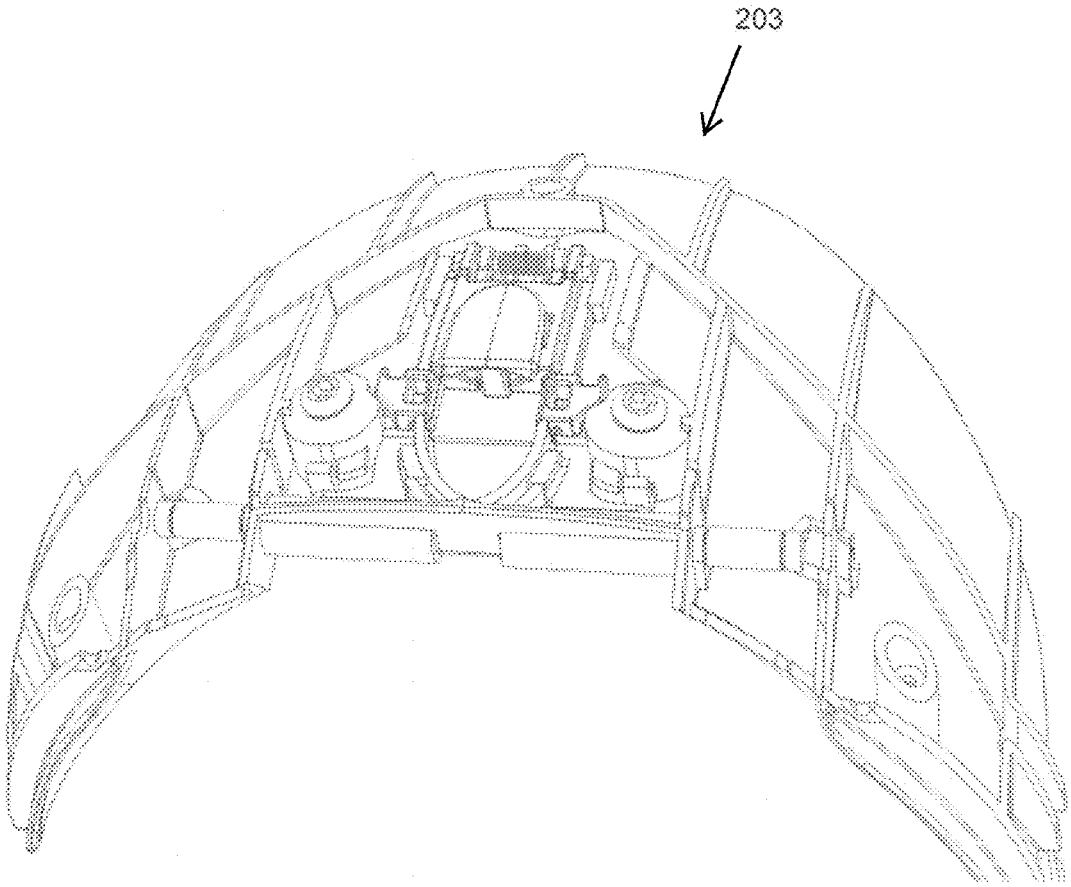
Figure 42:
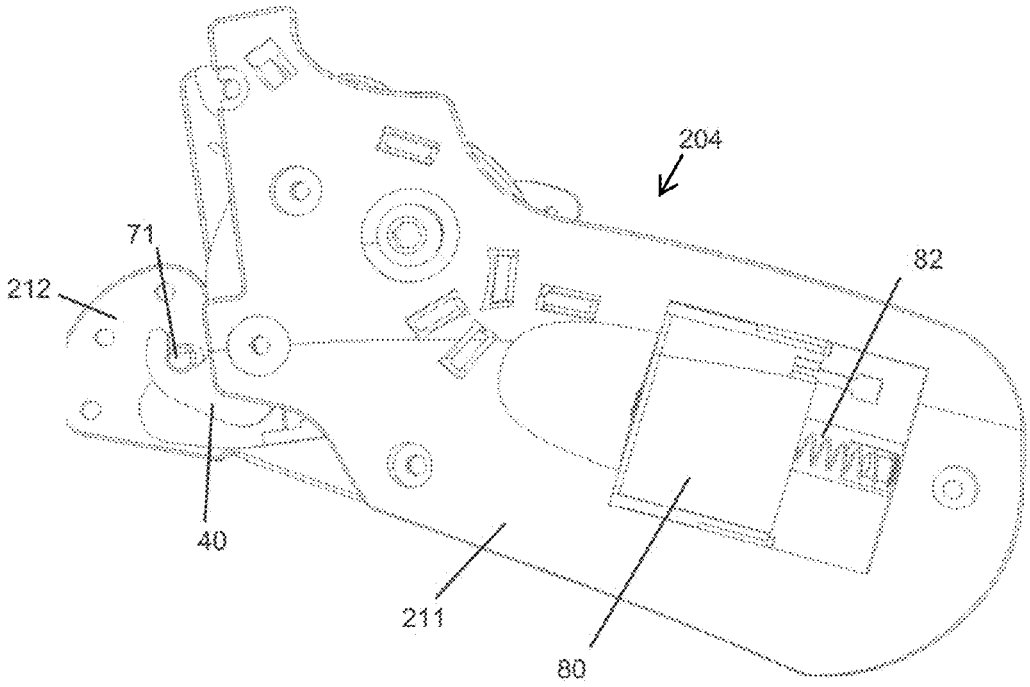

In the embodiments of FIG. 20 to FIG. 33 there are multiple covers 304 which conceal multiple portions of the mounting assembly. In the embodiment of FIG. 34 and FIG. 35 there is a single cover 304, which conceals a single mounting assembly. In another embodiment the cover is integrally formed with the main shell. It will be appreciated that properties of the resilient material affect the degree of shock absorption.

The cover is preferably mounted to the front shell using rivets. The mounting formation may be held in place via a combination of those rivets and a sandwiching between the shell and cover, and/or using adhesives.

It should be appreciated that in the above description of exemplary embodiments of the invention, various features of the invention are sometimes grouped together in a single embodiment, Figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Furthermore, while some embodiments described herein include some but not other features included in other embodiments, combinations of features of different embodiments are meant to be within the scope of the invention, and form different embodiments, as would be understood by those in the art. For example, in the following claims, any of the claimed embodiments can be used in any combination.

Thus, while there has been described what are believed to be the preferred embodiments of the invention, those skilled in the art will recognize that other and further modifications may be made thereto without departing from the spirit of the invention, and it is intended to claim all such changes and modifications as fall within the scope of the invention. That is, although the invention has been described with reference to a specific example, it will be appreciated by those skilled in the art that the invention may be embodied in many other forms.

The invention claimed is:

1. A protective helmet including:

a front shell and a rear shell, wherein in use a wearer's head is contained by the front shell and rear shell collectively; and an emergency release mechanism configured to release the front shell from the rear shell such that the front shell is removable from the rear shell; wherein the emergency release mechanism comprises:

a tab member located at a dorsal region of the front shell;

a cable system that physically couples:

the tab member to a first movable latch on a first side of the helmet; and the tab member to a second movable latch on a second side of the helmet, the second side being opposite to the first side;

wherein each movable latch is able to move between:

a first configuration, into which the latch is resiliently biased to lock the front shell to the rear shell at the location of the latch, into a second configuration, in which the front shell is not locked to the second shell at the location of the latch;

wherein the tab member is configured to be pulled, such that tension in the cable system instantaneously and simultaneously pulls each of the first and second movable latches against their resilient bias from their respective first configurations to their respective second configurations.

2. A protective helmet according to claim 1 wherein the helmet is a full-face helmet, and wherein the emergency release mechanism is configured to release the front shell from the rear shell such that the front shell is removable from the rear shell thereby to enable uninhibited access to the user's face.

3. A protective helmet according to claim 1 wherein the emergency release mechanism includes a tab member that is configured to be manually engaged thereby to simultaneously release multiple connector members that are configured to secure the front shell to the rear shell.

4. A protective helmet according to claim 3 wherein manually engaging the tab member includes lifting the tab member.

5. A method according to claim 3 wherein the multiple connector members define all points of connection between the front and rear shells, such that upon manual engagement of the tab member, the front shell is removable from the rear shell.

6. A helmet according to claim 3 wherein, following manual engaging of the tab member, a removable hinge member secures the front shell to the rear shell.

7. A protective helmet including:

a helmet shell; and an emergency release mechanism configured to release the helmet shell into a front shell and the rear shell that are separable from one another; wherein the emergency release mechanism comprises:

a tab member located at a dorsal region of the front shell;

a cable system that physically couples:

the tab member to a first movable latch on a first side of the helmet; and the tab member to a second movable latch on a second side of the helmet, the second side being opposite to the first side;

wherein each movable latch is able to move between:

a first configuration, into which the latch is resiliently biased to lock the front shell to the rear shell at the location of the latch, into a second configuration, in which the front shell is not locked to the second shell at he location of the latch;

wherein the tab member is configured to be pulled, such that tension in the cable system instantaneously and simultaneously pulls each of the first and second movable latches against their resilient bias from their respective first configurations to their respective second configurations.

8. A protective helmet according to claim 7 wherein the front shell includes a first region that protects a wearer's forehead and a second region that protects a wearer's chin.

9. A protective helmet according to claim 7 wherein the emergency release mechanism includes a tab member that is configured to be manually engaged thereby to simultaneously release multiple connector members that are configured to secure the front shell to the rear shell.

10. A method according to claim 9 wherein the multiple connector members define all points of connection between the front and rear shells, such that upon manual engagement of the tab member, the front shell is removable from the rear shell.

11. A method according to claim 9 wherein, following manual engaging of the tab member, a removable hinge member secures the front shell to the rear shell.

12. A protective helmet configured such that:

a user's head is inserted into the helmet by way of a first operation; and the user's head is removable from the helmet by either of: reversing the first operation; or operating a safety release mechanism thereby to split the protective helmet into two shells;

wherein the emergency release mechanism comprises:

a tab member located at a dorsal region of the front shell:

a cable system that physically couples:

the tab member to a first movable latch on a first side of the helmet; and the tab member to a second movable latch on a second side of the helmet, the second side being opposite to the first side;

wherein each movable latch is able to move between:

a first configuration, into which the latch is resiliently biased to lock the front shell to the rear shell at the location of the latch, into a second configuration, in which the front shell is not locked to the second shell at the location of the latch;

wherein the tab member is configured to be pulled, such that tension in the cable system instantaneously and simultaneously pulls each of the first and second movable latches against their resilient bias from their respective first configurations to their respective second configurations.

13. A protective helmet according to claim 12 wherein the helmet is defined by a front shell hingedly connected to a rear shell, and wherein the first operation includes:

positioning the helmet in an open configuration in which the helmet is able to be placed on a user's head or removed from the user's head; and progressing the helmet to a closed configuration wherein the rear shell is releasably lockingly engaged to the front shell for securely containing the head within the helmet.

14. A protective helmet according to claim 12 wherein two shells include a front shell includes a first region that protects a wearer's forehead and a second region that protects a wearer's chin.

15. A protective helmet according to claim 12 wherein the emergency release mechanism includes a tab member that is configured to be manually engaged thereby simultaneously releasing multiple connector members that are configured to secure the two shells together.

16. A method according to claim 12 wherein the multiple connector members define all points of connection between the shells, such that upon manual engagement of the tab member, the front shells are completely separable from one another.

17. A method according to claim 12 wherein, following manual engaging of the tab member, a removable hinge member secures the shells together.

* * * * *